US009939746B2

(12) United States Patent
Arimura et al.

(10) Patent No.: US 9,939,746 B2
(45) Date of Patent: Apr. 10, 2018

(54) ELECTROPHOTOGRAPHIC MEMBER, PROCESS CARTRIDGE, AND ELECTROPHOTOGRAPHIC APPARATUS

(71) Applicant: CANON KABUSHIKI KAISHA, Tokyo (JP)

(72) Inventors: Hideya Arimura, Suntou-gun (JP); Shohei Urushihara, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/183,383

(22) Filed: Jun. 15, 2016

(65) Prior Publication Data

US 2016/0370719 A1 Dec. 22, 2016

(30) Foreign Application Priority Data

Jun. 18, 2015 (JP) ..... 2015-123029

(51) Int. Cl.

| | |
|---|---|
| ***G03G 15/00*** | (2006.01) |
| ***G03G 5/10*** | (2006.01) |
| ***G03G 15/02*** | (2006.01) |
| ***G03G 15/08*** | (2006.01) |

(52) U.S. Cl.

CPC ..... *G03G 5/105* (2013.01); *G03G 15/0233* (2013.01); *G03G 15/0812* (2013.01); *G03G 15/0818* (2013.01)

(58) Field of Classification Search

CPC ..... G03G 5/105; G03G 15/0812; G03G 15/0233; G03G 15/0818

See application file for complete search history.

(56) References Cited

U.S. PATENT DOCUMENTS

2013/0251403 A1* 9/2013 Matsuda ..... G03G 15/0233 399/111

FOREIGN PATENT DOCUMENTS

| | | | | |
|---|---|---|---|---|
| JP | 2014-066857 A | 4/2014 | | |
| WO | WO 2013/094127 A1 * | 6/2013 | ..... | C08L 71/02 |
| WO | WO2013/094127 A1 | 4/2015 | | |

OTHER PUBLICATIONS

English translation (Jul. 19, 2017) of the Patent WO 2013094127 A1.*

* cited by examiner

*Primary Examiner* — Eisa B Elhilo

(74) *Attorney, Agent, or Firm* — Canon U.S.A., Inc. IP Division

(57) ABSTRACT

The electrophotographic member includes an electroconductive substrate and an electroconductive surface layer. The surface layer contains an electroconductivity imparting agent and a polyrotaxane including a first and a second polyrotaxane molecule.

The first polyrotaxane molecule includes a first cyclic molecule, and the second polyrotaxane molecule includes a second cyclic molecule. The cyclic molecules of the first and the second polyrotaxane molecules are bound in such a manner that the oxygen atom of a hydroxy group of the first cyclic molecule and the oxygen atom of a hydroxy group of the second cyclic molecule are bound with a structure represented by the following formula (1):

$$*—R^1—Z—R^2—**$$

In this formula, z represents a linking group, and "*" and "**" represent binding sites to be bound to either of the oxygen atoms derived from the hydroxy groups of the first and the second cyclic molecule. $R^1$ and $R^2$ each represent a specific structure.

5 Claims, 5 Drawing Sheets

ELECTROPHOTOGRAPHIC MEMBER, PROCESS CARTRIDGE, AND ELECTROPHOTOGRAPHIC APPARATUS

BACKGROUND OF THE INVENTION

Field of the Invention

The present disclosure relates to an electrophotographic member used in an electrophotographic apparatus, and a process cartridge and an electrophotographic apparatus each including the electrophotographic member.

Description of the Related Art

An electrophotographic member is used as a variety of devices, such as a developer bearing member (e.g. developing roller), a developer feed roller, a transfer roller, a charging member (e.g. charging roller), a cleaning blade, and a developer layer thickness control member (e.g. developing blade). The electric resistance of such electrophotographic members is generally in the range of $10^3$ Ω·cm to $10^{10}$ Ω·cm.

From the viewpoint of enhancing durability, some of the electrophotographic members are provided with a surface layer.

Japanese Patent Laid-Open No. 2014-66857 discloses an electrophotographic member having a surface layer containing a polyrotaxane having a cross-linked structure in which polyrotaxane molecules each including a cyclic molecule having a functional group reactive with the isocyanate group are cross-linked to each other with an isocyanate compound having isocyanate groups at both ends thereof.

More specifically, the cross-linked structure disclosed in this patent document has a first cross-linked site formed by a reaction of one of the isocyanate groups of the isocyanate compound with the functional group of the cyclic molecule of one of the polyrotaxane molecules, and a second cross-linked site formed by a reaction of the other isocyanate group with the functional group of the cyclic molecule of another polyrotaxane molecule. According to this cited patent document, this surface layer has a higher durability than ever and, in addition, exhibits a low hardness and a low temperature dependence in a temperature range in which the electrophotographic member is used.

International Publication No. WO 2013/094127 discloses a charging member including an electroconductive surface layer containing a compound produced by chemically binding the cyclic molecule of a first polyrotaxane molecule to the cyclic molecule of a second polyrotaxane molecule. According to this cited document, the charging member is effective in reducing streaks formed in the electrophotographic image by uneven densities resulting from compression set.

The printing speed of electrophotographic apparatuses has been being increased. As the printing speed is increased, heat generated by friction between members increases, and the temperature of the members varies largely between when the apparatus is in operation and when it is not. Accordingly, it is required that electrophotographic members maintain a high durability even if it is used in still more severe environment.

The present disclosure is directed to providing an electrophotographic member that has an electric resistance unlikely to vary much in a variety of environments, and that is useful in stably forming high-quality electrophotographic images.

Also, the present disclosure is directed to providing a process cartridge and an electrophotographic apparatus that can stably form high-quality electrophotographic images.

SUMMARY OF THE INVENTION

According to an aspect of the present disclosure, there is provided an electrophotographic member including an electroconductive substrate and an electroconductive surface layer. The surface layer contains an electroconductivity imparting agent, and a bound polyrotaxane of which a first polyrotaxane and a second polyrotaxane are bound.

The first polyrotaxane includes a first cyclic molecule and a first linear-chain molecule threaded through the first cyclic molecule. The first linear-chain molecule has two blocking groups at both ends of thereof so as to prevent the first cyclic molecule from being dissociated from the first linear-chain molecule. The second polyrotaxane includes a second cyclic molecule and a second linear-chain molecule threaded through the second cyclic molecule. The second linear-chain molecule has two blocking groups at both ends thereof so as to prevent the second cyclic molecule from being dissociated from the second linear-chain molecule. Each of the first cyclic molecule and the second cyclic molecule has at least one hydroxy group. The first polyrotaxane molecule and the second polyrotaxane molecule are bound to each other in such a manner that the oxygen atom derived from the hydroxy group of the first cyclic molecule is bound to the oxygen atom derived from the hydroxy group of the second cyclic molecule with a structure represented by the following structural formula (1):

$$*—R^1—Z—R^2—**$$

In structural formula (1), Z represents a linking group, signs * and ** represent binding sites to be bound to either of the oxygen atoms derived from the hydroxy groups of the first cyclic molecule and the second cyclic molecule, and $R^1$ and $R^2$ each represent a structure represented by any one of the following structural formulas (2) to (7):

(2)

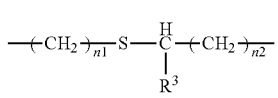

(3)

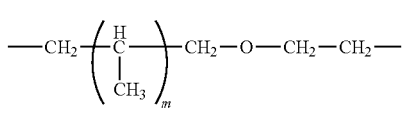

(4)

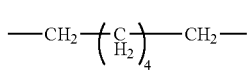

(5)

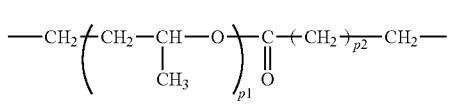

(6)

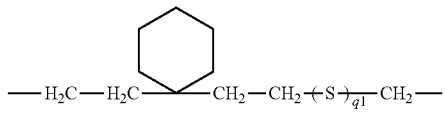

(7)

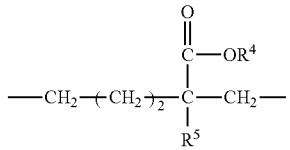

In structural formula (2), $R^3$ represents a hydrogen atom or a methyl group, and n1 and n2 each represent an integer of 1 to 4. In structural formula (3), m represents 0 or 1. In structural formula (5), p1 and p2 each represent 0 or 1. In structural formula (6), q1 represents 0 or 1. In structural formula (7), $R^4$ represents a hydrocarbon group having a carbon number of 5 to 47, or an alkyl group having a polyether structure and a total carbon number of 5 to 47, and $R^5$ represents a hydrogen atom or a methyl group.

The electrophotographic member of the present disclosure may be used as, for example, a developer bearing member (e.g. developing roller), a developer feed roller, a transfer roller, a charging member (e.g. charging roller), a cleaning blade, a developer layer thickness control member (e.g. developing blade), and so forth.

According to another aspect of the present disclosure, a process cartridge capable of being removably attached to an electrophotographic apparatus is provided. The process cartridge includes at least one member selected from the group consisting of a charging member, a developer bearing member, and a developer layer thickness control member, and the at least one member is the above-described electrophotographic member.

According still another aspect of the present disclosure, there is provided an electrophotographic apparatus including an electrophotographic photosensitive member and at least one member selected from the group consisting of a charging member, a developer bearing member, and a developer layer thickness control member. The at least one member is the above-described electrophotographic member.

Further features of the present invention will become apparent from the following description of exemplary embodiments with reference to the attached drawings.

DESCRIPTION OF THE EMBODIMENTS

The present inventors have conducted research for an electrophotographic member including a surface layer containing polyrotaxane, useful in enhancing durability and reducing uneven densities in the electrophotographic image resulting from compression set, as disclosed in Japanese Patent Laid-Open No. 2014-66857 and International Publication No. WO 2013/094127. Then, the inventors found that some of the electrophotographic members including a surface layer containing a polyrotaxane in which the cyclic molecules are bound to each other exhibited a decrease in electric resistance when repeatedly exposed to an environmental cycle between a high-temperature, high-humidity environment and a normal-temperature, normal-humidity environment.

In order to achieve an electrophotographic member whose electric resistance is not varied even when used in various environments, the present inventors intensively studied the polyrotaxanes disclosed in Japanese Patent Laid-Open No. 2014-66857 and International Publication No. WO 2013/094127.

Then, it was found that an electrophotographic member including a surface layer containing a bound polyrotaxane of which a first polyrotaxene and a second polyrotaxene are bound, exhibited a stable electric resistance, i.e. a fluctuation of an electric resistance is suppressed even when the electrophotographic member is repeatedly exposed to different environments such as a high-temperature, high-humidity environment and a normal-temperature, normal-humidity environment. Here, the bound polyrotaxene has a structure of which the first polyrotaxene and the second polyrotaxene are bound at cyclic molecules of which the respective polyrotaxene have, with a linking group having a specific structure.

Figure 2A:
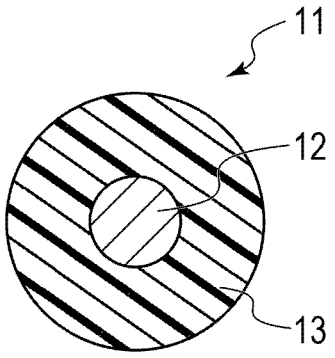
FIGS. 2A and 2B are each an illustrative representation of an electrophotographic member according to an embodiment of the present disclosure.
Figure 2B:
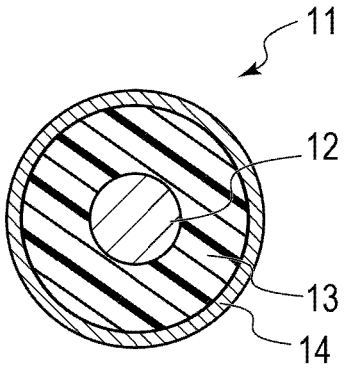

FIGS. 2A and 2B are each a sectional view of an electrophotographic member in a roller form (hereinafter referred to as "electroconductive roller") taken in the direction perpendicular to the axis of the roller.

The electroconductive roller 11 shown in FIG. 2A includes an electroconductive substrate 12 and an elastic layer 13 on the periphery of the substrate 12. In this structure, the elastic layer 13 corresponds to the electroconductive surface layer of the subject matter of the present disclosure and contains a bound polyrotaxane having a specific structure described herein.

The electroconductive roller 11 shown in FIG. 2B includes an electroconductive substrate 12, an elastic layer 13 on the periphery of the substrate 12, and an electroconductive resin layer 14 on the periphery of the elastic layer 13. The electroconductive resin layer 14, which is the surface layer, contains a bound polyrotaxane having a specific structure described herein. In this electroconductive roller, the elastic layer 13 does not necessarily contain the bound polyrotaxane.

Substrate

The substrate 12 of each of the electroconductive rollers 11 shown in FIGS. 2A and 2B acts as a solid or hollow electrode and a support member of the electroconductive roller 11. The substrate 12 is made of a metal such as aluminum or copper, an alloy such as stainless steel, iron plated with chromium or nickel, or an electroconductive material such as an electroconductive synthetic resin.

Elastic Layer

Elastic Layer in FIG. 2A

The elastic layer 13 in the electroconductive roller 11 shown in FIG. 2A enables the electroconductive roller to have an elasticity required for forming a nip with a predetermined width at the contact portion of the electroconductive roller with an electrophotographic photosensitive member (hereinafter referred to as photosensitive member). In the structure shown in FIG. 2A, since the elastic layer 13 defines the outermost layer or surface layer, the elastic layer must contain a bound polyrotaxane having a specific structure, as described above.

Also, it is advantageous that the elastic layer 13 contain a rubber material. Examples of the rubber material, which are used singly or in combination, include:

ethylene-propylene-diene monomer (EPDM) rubber, acrylonitrile-butadiene rubber (NBR), chloroprene (CR)

rubber, natural rubber (NR), isoprene rubber (IR), styrene-butadiene rubber (SBR), fluorocarbon rubber, silicone rubber, epichlorohydrin rubber, NBR hydrate, and urethane rubber.

In view of compression set and flexibility, silicone rubber is particularly suitable. Exemplary silicone rubbers include polydimethylsiloxane, polytrifluoropropylsiloxane, polymethylvinylsiloxane, polyphenylvinylsiloxane, and copolymers of two or more of these polysiloxanes.

Elastic Layer in FIG. 2B

The elastic layer 13 of the electroconductive roller 11 shown in FIG. 2B does not necessarily contain the polyrotaxane according to the present disclosure and may merely contain a rubber material as cited above.

The elastic layer 13 optionally contains additives, such as an electroconductivity imparting agent, an electrically non-conductive filler, a cross-linking agent, and a catalyst, to such an extent as to achieve the purpose in being added, without reducing the effect of the subject matter of the present disclosure.

Examples of the electroconductivity imparting agent include carbon black, electroconductive metals such as aluminum and copper, fine particles of an electroconductive metal oxide such as zinc oxide, tin oxide, or titanium oxide, and ionic conducting agents such as quaternary ammonium salts. In view of electrical conductivity-imparting ability, reinforcement, and availability, carbon black is more advantageous.

Examples of the electrically non-conductive filler include silica, quartz powder, titanium oxide, zinc oxide, and calcium carbonate.

Examples of the crosslinking agent include, but are not limited to, tetraethoxysilane, di-t-butyl peroxide, 2,5-dimethyl-2,5-di(t-butylperoxy)hexane, and dicumyl peroxide.

Electroconductive Resin Layer in FIG. 2B

The electroconductive resin layer 14 of the electroconductive roller shown in FIG. 2B contains the bound polyrotaxane having a specific structure according to the present disclosure, a binder resin, and an electroconductivity imparting agent.

A known resin may be used as the binder resin without particular limitation. Examples of such a binder resin, which may be used singly or in combination, include urethane resin, epoxy resin, urea resin, ester resin, amide resin, imide resin, amide-imide resin, phenol resin, vinyl resin, silicone resin, and fluorocarbon resin. Urethane resin is advantageous in terms of abrasion resistance and flexibility.

To the resin, one or more of known compounding agents, such as a filler, an electroconductivity imparting agent, a softening agent, a processing aid, a tackifier, a detackifier, and a foaming agent, may be added to such an extent as to achieve the purpose in being added, without reducing the effect of the subject matter of the present disclosure.

Examples of the electroconductivity imparting agent include carbon black, electroconductive metals such as aluminum and copper, fine particles of an electroconductive metal oxide such as zinc oxide, tin oxide, or titanium oxide, and ionic conducting agents such as quaternary ammonium salts, borates, perchlorates, and ionic liquids.

Among these, carbon black and ionic electroconductivity imparting agents are advantageous from the viewpoint of reducing the fluctuation in resistance that can occur when a lot of printing is repeated under high-temperature high humidity environment.

If electroconductive fine particles are used, the proportion of such an electrical conductivity imparting agent may be in the range of 10 parts by mass to 30 parts by mass relative to 100 parts by mass of the resin solids in the surface layer in view of hardness, dispersibility, and electrical conductivity. If an ionic conducting agent is used, the proportion of such an electrical conductivity imparting agent may be in the range of 0.1 part by mass to 10 parts by mass relative to 100 parts by mass of the resin solids in the surface layer in view of electrical conductivity and prevention of bleed out.

The electroconductive resin layer 14 may optionally contain additives, such as an electrically non-conductive filler, a crosslinking agent, and a catalyst, to such an extent as to achieve the purpose in being added, without reducing the effect of the subject matter of the present disclosure, as in the above-described elastic layer 13. The additives may be selected from those cited for the elastic layer 13. The electroconductive layer is formed by polymerization with heat, an electron beam, ultraviolet radiation, or the like for curing the resin.

In addition to the additives, for example, a photo-radical polymerization initiator or a thermal radical polymerization initiator may be added, depending on the monomer used.

Examples of the photo-radical polymerization initiator include acetophenone compounds, benzoin compounds, benzophenone compounds, phosphine oxides, ketals, anthraquinone compounds, thioxanthones, azo compounds, peroxides, 2,3-dialkyldione compounds, disulfides, fluoroamines, aromatic sulfonium compounds, lophine dimers, onium salts, borates, active esters, active halogens, inorganic complexes, and coumarins.

These initiators may be used singly or in combination. The proportion of the photo-radical polymerization initiator may be in the range of 0.1 part by mass to 15 parts by mass relative to 100 parts by mass of the monomer. Furthermore, a photo-sensitizer, such as n-butylamine or triethylamine may be added, if necessary. The thermal radical polymerization initiator may be an organic or inorganic peroxide or an organic azo or diazo compound.

Bound Polyrotaxane

Figure 1:
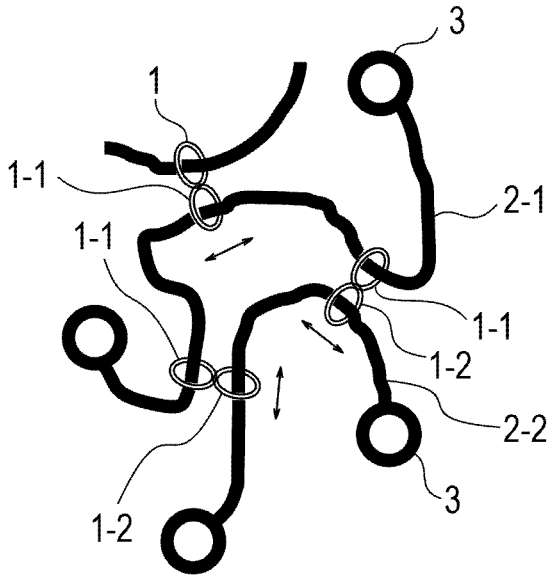
FIG. 1 is an illustrative representation of a bound polyrotaxane used in the present disclosure.

Referring now to FIG. 1, the bound polyrotaxane having a specific structure, contained in the surface layer of the electrophotographic member according to the present disclosure will be described.

Polyrotaxane is a compound in which a linear-chain molecule is threaded through cyclic molecules.

In FIG. 1, a linear-chain molecule 2-1 is threaded through cyclic molecules 1-1, and the cyclic molecules 1-1 are movable along the linear-chain molecule 2-1. The linear-chain molecule 2-1 has blocking groups 3 at both ends thereof so as to prevent the cyclic molecules 1-1 from being dissociated from the linear-chain molecule 2-1.

Similarly, a linear-chain molecule 2-2 is threaded through cyclic molecules 1-2, and the cyclic molecules 1-2 are movable along the linear-chain molecule 2-2. The linear-chain molecule 2-2 has blocking groups 3 at both ends thereof so as to prevent the cyclic molecules 1-2 from being dissociated from the linear-chain molecule 2-2. In the following description, a polyrotaxane molecule including the linear-chain molecule 2-1 and the cyclic molecules 1-1 is referred to as a first polyrotaxane molecule; and a polyrotaxane molecule including the linear-chain molecule 2-2 and the cyclic molecules 1-2 is referred to as a second polyrotaxane molecule.

In the bound polyrotaxane shown in FIG. 1 according to the present disclosure, the first cyclic molecule 1-1 threaded with the first linear-chain molecule 2-1 and the second cyclic molecule 1-2 threaded with the second linear-chain molecule 2-2 are bound to each other in such a manner that the oxygen atoms derived from the hydroxy groups of the first and the second cyclic molecules are bound to each other with the structure represented by the following structural formula (1):

$$*—R^1—Z—R^2—**$$

In structural formula (1), Z represents a linking group, signs * and ** represent binding sites to be bound to either of the oxygen atoms derived from the hydroxy groups of the first cyclic molecule and the second cyclic molecule, and $R^1$ and $R^2$ each represent a structure represented by any one of the following structural formulas (2) to (7). Among these structural formulas, formulas (2) to (4) are advantageous, and formulas (2) and (3) are more advantageous. These advantageous structures allow the electrophotographic member to exhibit more stable electrical resistance when is exposed to a variety of environments.

(2)

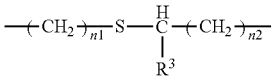

(3)

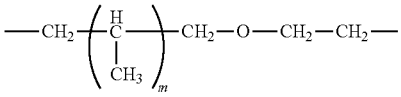

(4)

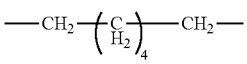

(5)

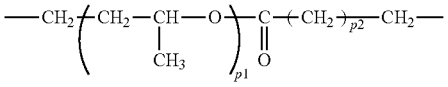

(6)

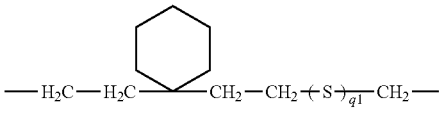

(7)

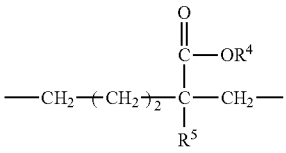

In structural formula (2), $R^3$ represents a hydrogen atom or a methyl group, and n1 and n2 each represent an integer of 1 to 4. In structural formula (3), m represents 0 or 1. In structural formula (5), p1 and p2 each represent 0 or 1. In structural formula (6), q1 represents 0 or 1. In structural formula (7), $R^4$ represents a hydrocarbon group having a carbon number of 5 to 47 or an alkyl having a polyether structure and a total carbon number of 5 to 47, and $R_5$ represents a hydrogen atom or a methyl group. The alkyl group having a polyether structure and a total carbon number of 5 to 47 may be represented by the following structural formula (7-1): $—R^{41}—(OR^{42})_{n4}—OR^{43}$.

In structural formula (7-1), $R^{41}$ and $R^{42}$ each represents an alkylene group, and $R^{43}$ represents an alkyl group. Also, n4 represents an integer of 0 or more. The total carbon number in the structure of structural formula (7-1) is in the range of 5 to 47.

The polyrotaxane having such a structure is more flexible than rubbers and elastomers having many cross-linked points or bound points.

By adding the bound polyrotaxane having the above-described structure to the electroconductive surface layer, the variation in electrical resistance of the surface layer can be reduced even if the electrophotographic member is repeatedly exposed to an environmental cycle between a high-temperature, high-humidity environment and a normal-temperature, normal-humidity environment. The reason of this can be explained as below.

Polyrotaxane is a compound having a molecular structure including cyclic molecules and a linear-chain molecule threaded through the cyclic molecules. Each end of the linear-chain molecule is capped so that cyclic molecules are not dissociated. The linear-chain molecule is threaded through a plurality of cyclic molecules. In a high-temperature, high-humidity environment, adjacent cyclic molecules threaded with a single linear-chain molecule come close to each other, and the adjacent cyclic molecules are tied up with each other due to an interaction such as a hydrogen bond between the hydroxy groups in the cyclic molecules. As a result of that, the motion of the cyclic molecules is likely to be restricted. In the case that such restriction against the cyclic molecules is removed by reducing temperature, the cyclic molecules return to a state where they are freely movable, and a bound polyrotaxene of which a cyclic molecule of the first polyrotaxane and a cyclic molecule of the second polyrotaxane are bound with each other, also exhibits a similar behavior.

In the case that a liking part binding the cyclic molecules of the first and the second polyrotaxene includes a group having a linkage which exhibits a hydrogen bond-like interaction such as a urethane linkage, or a group which exhibits an aromatic property, such as a benzyl group, the substituents of different cyclic molecules interact with each other, thereby restricting the motion of the cyclic molecules. In the case of a polyrotaxane including cyclic molecules having such a substituent, therefore, the restriction of the cyclic molecules is not removed by reducing temperature, and the motion of the cyclic molecules remains restricted. If the motion of the cyclic molecules of polyrotaxane is restricted, resistance decreases. The present inventors assume that the reason of this is as below.

In the case of a bound polyrotaxene of which cyclic molecules of the first and second polyrotaxanes are bound, when an interaction such as a hydrogen bond is worked between the cyclic molecules surrounding a linear-chain molecule of the respective polyrotaxane molecules, a dense part where binding sites of the first and the second polyrotaxane molecules are densely concentrated, is formed because the cyclic molecular surrounding the linear-chain molecule are come close to each other due to the interaction. As a result of that, a sparse part where the binding sites are sparsely located. In the case of a surface layer containing electroconductive particles as an electroconductivity imparting agent, the electroconductive particles tend to exist at the sparse part, the distance between the electroconductive particles becomes closer, and therefore, the electric resistance decreases. In the case of a surface layer containing an ionic electroconductivity imparting agent, ions tend to move in the sparse portion, and therefore the electric resistance decreases.

In the bound polyrotaxane of the present disclosure, cyclic molecules of different polyrotaxane molecules are bound to each other with a chemical linkage represented by structural formula (1) therebetween. $R^1$ and $R^2$ of structural formula (1) are each represented by any one of the structural formulas (2) to (7). These linkages allow molecular chains to move freely. Also, unlike molecules having an aromatic property that can cause π-π stacking therebetween or urethane linkages that can form a hydrogen bond therebetween, the force for restricting the cross-linked cyclic molecules is weak even if the cross-linked molecular chains come close to each other. Accordingly, if the cyclic molecules are bound to each other to some extent in a high-temperature, high-humidity environment, the force of restriction is probably very weak. The present inventors assume that this is the reason why the cross-links do not have an uneven distribution and the variation in resistance is reduced even though the resin is repeatedly exposed to an environmental cycle between a high-temperature, high-humidity environment and a normal-temperature, normal humidity environment.

If an aliphatic hydrocarbon group (may be cyclic) having a carbon number of 5 or more is substituted for the hydroxy group of the cyclic molecule of the bound polyrotaxane, the variation in resistance is further reduced. Cyclic molecules having such a large substituent do not come close to each other to the extent that interaction occurs therebetween, due to the steric hindrance of the large substituents, even if the motility of the cyclic molecules is increased in a high-temperature, high humidity environment. Consequently, the cross-linked points are evenly distributed, so that the resistance of the resin does not decrease easily even in a high-temperature, high-humidity environment. The inventors think that accordingly the variation in resistance can be reduced effectively even if the ambient environment is repeatedly changed.

A process for preparing the bound polyrotaxane will now be described.

Preparation of Bound Polyrotaxane

The bound polyrotaxane may be prepared by, but not limited to, a process including the following steps:

(1) mixing cyclic molecules and linear-chain molecules to prepare a pseudopolyrotaxane in which the linear-chain molecule is threaded through the cyclic molecules;

(2) preparing a polyrotaxane by blockading both ends of the linear-chain molecule with blocking groups so that the cyclic molecules of the pseudopolyrotaxane are not dissociated from the linear-chain molecule; and (3) binding at least two polyrotaxane molecules by binding the cyclic molecules between the at least two polyrotaxane molecules with a chemical linkage represented by structural formula (1).

The process may further include the following step:

(4) substituting one or more of the hydroxy groups of the cyclic molecules with a linear or branched hydrocarbon group or aliphatic hydrocarbon group (may be cyclic) having a carbon number of 5 or more.

In step (1), the number of the cyclic molecules threaded with one linear-chain molecule is at least two. The percentage of the cyclic molecules for each linear-chain molecule is desirably in the range of 1% in number to 50% in number relative to the maximum number of the cyclic molecules that can be threaded with the linear-chain molecule, in view of the degree of freedom in the motion of the cyclic molecules.

Step (3) may be performed by, but not limited to, cross-linking polyrotaxane molecules by either of the following steps (3-1) and (3-2):

(3-1) allowing the hydroxy group of the cyclic molecule of the polyrotaxane molecule to react with a compound having a reaction group capable of forming a structure represented by any one of the structural formulas (2) to (7) at one end thereof and a reactive group such as a vinyl group or a thiol group at the other end to substitute the structure represented by any one of the structural formulas (2) to (7) for the hydroxy group, and then allowing the reactive group with a cross-linking agent; and (3-2) allowing a polyrotaxane molecule including a cyclic molecule having a hydroxy group to react with a cross-linking agent having, for example, halogen atoms at both ends of the molecule thereof.

Step (4) may be performed before step (1), between steps (1) and (2), between steps (2) and (3), or after step (3). Advantageously, step (4) is performed between steps (2) and (3) in view of reaction.

The percentage of the cross-links and substituents formed by steps (3) and (4) is desirably in the range of 20% to 80% relative to the maximum amount of the hydroxy groups of the cyclic molecules that can be modified, from the viewpoint of preventing the decrease of the freedom in motion of the cyclic molecules. When the percentage of substitution is 20% or more, the substituents can prevent the cyclic molecules effectively from coming close to each other. In contrast, when the percentage of substitution is 80% or less, the steric hindrance of the substituents is not so large as to excessively increase repulsion and is thus not likely to restrict the motion of the cyclic molecules in a high-temperature, high-humidity environment.

The materials used for preparing the polyrotaxane according to the present disclosure will be described below.

Cyclic molecules of Polyrotaxane

The cyclic molecule of the polyrotaxane has a hydroxy group, and is substantially cyclic in such a manner that it is not necessarily closed and may be in a shape like letter "C" as long as it is freely movable along the linear-chain molecule. The compounds comprising such cyclic molecules include cyclodextrins, such as α-cyclodextrin (α-CD), β-cyclodextrin, γ-cyclodextrin, dimethylcyclodextrin, and glucosylcyclodextrin, derivatives or modified compounds thereof, and benzocrown derivatives or modified benzocrown, such as carboxybenzocrown. These compounds may be used singly or in combination. α-Cyclodextrin, β-cyclodextrin, γ-cyclodextrin, and derivatives or modified compounds of these cyclodextrins are relatively available and advantageous for surrounding the linear-chain molecule. In view of reactivity, α-cyclodextrin and a derivative or modified compound thereof is more advantageous.

Desirably, the cyclic molecule has at least one hydroxyl group on the outer side of the cyclic structure. The cyclic molecule may further have a reaction group such as a vinyl group or a thiol group. Also, the cyclic molecule may have a structure represented by any one of structural formulas (2) to (7), and this structure may have a vinyl, thiol, or isocyanate group at the end thereof. However, these groups of the cyclic molecule are desirably unreactive with the blocking group during the reaction for blocking.

For example, such a cyclic molecule may be an alkenyl-modified cyclodextrin produced by, for example, modifying hydroxy groups of α-cyclodextrin, a cyclodextrin substituted by, for example, a vinyl group, an alkylthiol-modified cyclodextrin, a cyclodextrin substituted by an ethylsulfanyl group, a terminal isocyanate-modified cyclodextrin, or a cyclodextrin substituted by, for example, octyl isocyanate.

Also, the hydroxy groups not involved in the linkage with the cyclic molecules of other polyrotaxane molecules may be substituted with an acetyl group or a hydrophobic group such as a hydrocarbon group.

Advantageously, at least some of the hydroxy groups of at least either the first cyclic molecule of the first polyrotaxane molecule or the second cyclic molecule of the second polyrotaxane molecule are substituted with a structure represented by structural formula (8): —O—$R^6$.

By substituting some of the hydroxy groups of the cyclic molecules with a group represented by structural formula (8), the cyclic molecules are prevented effectively from coming close to each other. Consequently, the electric resistance of the electrophotographic member can be further stabilized.

In structural formula (8), $R^6$ represents an aliphatic hydrocarbon group having a carbon number of 5 or 6, an alkoxy-substituted alkyl group having a total carbon number of 5 or 6, or a thioether-substituted alkyl group having a total carbon number of 5 or 6.

More specifically, the group of structural formula (8) in which $R^6$ is an alkoxy-substituted alkyl group having a total carbon number of 5 or 6 is represented by the following structural formula (8-1): $—O—R^{61}—O—R^{62}$ In structural formula (8-1), $R^{61}$ represents an alkylene group, and $R^{62}$ represents an alkyl group. The sum of the carbon number of $R^{61}$ and the carbon number of $R^{62}$ is 5 or 6. The group of structural formula (8) in which $R^6$ is a thioether-substituted alkyl group having a total carbon number of 5 or 6 is represented by the following structural formula (8-2): $—O—R^{63}—S—R^{64}$.

In structural formula (8-2), $R^{63}$ represents an alkylene group, and $R^{64}$ represents an alkyl group. The sum of the carbon number of $R^{63}$ and the carbon number of $R^{64}$ is 5 or 6.

If some of the hydroxy groups of a cyclic molecule of the polyrotaxane molecule are substituted with a group represented by structural formula (8), the substitution is performed such that "—OH" is changed into "$—OR^6$" or "$—CH_2OH$" is changed into "$—CH_2OR^6$".

Linear-Chain Molecule of Polyrotaxane

The linear-chain molecule of the polyrotaxane is a molecule or a substance that is surrounded by the cyclic molecules and thus can be integrated with the cyclic molecules without any covalent bond. Any molecule can be used as the linear-chain molecule as long as it is linear.

The term "linear-chain" means that the chain of the molecule is substantially linear. More specifically, the linear-chain molecule may have branches as long as the cyclic molecules can slide or move along the linear-chain molecule. Also, the linear-chain molecule may be bent or helical as long as the cyclic molecules can slide or move along the linear-chain molecule. Furthermore, the length of the linear-chain molecule is not particularly limited as long as the cyclic molecules can slide or move along the linear-chain molecule.

The compounds comprising the linear-chain molecule include polyalkylene glycols, such as polyethylene glycol and polypropylene glycol, polytetrahydrofuran, polyisoprene, polybutadiene, polyisobutylene, polydimethylsiloxane, polyethylene, and polypropylene. From the viewpoint of flexibility, polyethers and polydimethylsiloxane are advantageous.

The linear-chain molecule of the polyrotaxane has blocking groups at both ends thereof for preventing the cyclic molecules from being dissociated therefrom. The blocking group may have any structure as long as it can act as a stopper to prevent the cyclic molecules from being dissociated. For preventing the dissociation, a bulky group may be used to physically prevent the dissociation, or an ionic group may be used to electrically prevent the dissociation. Examples of such a terminal group include dinitrophenyl groups, such as 2,4-dinitrophenyl and 3,5-dinitrophenyl, cyclodextrin, adamantane groups, trityl groups, fluorescein, pyrene, and derivatives and modified forms of these groups.

Binding Agent

The binding agent may have any structure without being particularly limited as long as it has at the ends thereof two or more reactive groups capable of reacting with the reactive groups of the cyclic molecules. The structure of the binding agent other than the reactive groups may be in the form of a hydrocarbon chain or any other resinous structure. Examples of the resinous structure include one or a combination of the structures of urethane resin, epoxy resin, urea resin, ester resin, amide resin, imide resin, amide-imide resin, vinyl resin, silicone resin, and fluorocarbon resin. The reactive group of the binding agent is selected depending on the reactive group of the cyclic molecule. Examples of the reactive group of the binding agent include a thiol group, a vinyl group, or a hydroxy group.

More specifically, the cross-linking agent may be:

prepolymer having a thiol-modified terminal produced by Michael addition of a (meth)acrylic monomer with an excessive amount of compound having at least two thiol groups, such as 1,8-octanedithiol;

urethane prepolymer having a vinyl-modified terminal produced by a reaction of a prepolymer having a plurality of isocyanate groups with a compound having a hydroxy group at one end thereof and a vinyl group at the other end, such as 3-butene-1-ol or 5-hexene-1-ol; or prepolymer produced by a reaction of a prepolymer having a plurality of isocyanate groups with a compound having an amino group at one end thereof and a vinyl group at the other end, such as 3-butynylamine or 5-hexylamine.

Although the prepolymer having a plurality of isocyanate groups is not particularly limited, it is advantageous in view of flexibility and strength that the structure be formed by a reaction of a polyether component with an aromatic isocyanate component, such as tolylene diisocyanate, diphenylmethane diisocyanate, or polymeric diphenylmethane diisocyanate.

In case that a protrusion is formed on the surface of the electrophotographic member, fine particles may be added to the electroconductive resin layer defining the surface layer for controlling the surface roughness. The fine particles added for controlling the surface roughness may have an average particle size of 3 μm to 20 μm. The proportion of the fine particles added to the surface layer may be 1 part to 50 parts by mass relative to 100 parts by mass of binder resin solids. The fine particles for controlling the surface roughness may be made of polyurethane resin, polyester resin, polyether resin, polyamide resin, acrylic resin, or phenol resin. Two or more resins may be used in combination for the fine particles.

The electroconductive resin layer may be formed by, but not limited to, a method using a paint, such as spray coating, dip coating, or roll coating. A dip coating method performed in such a manner that a paint overflows the top edge of the dipping bath, as disclosed in Japanese Patent Laid-Open No. 57-5047, is simple as the method for forming a resin layer and is superior in manufacture stability.

The electrophotographic member of the present disclosure may be uses in both a non-contact type or contact-type developing unit using a one-component magnetic or non-magnetic developer and a developing unit using a two-component developer.

A process cartridge and an electrophotographic apparatus, using the electrophotographic member of the present disclosure will be described below.

The process cartridge includes at least one of a charging member, a developer bearing member, and a developer thickness control member.

Figure 3:
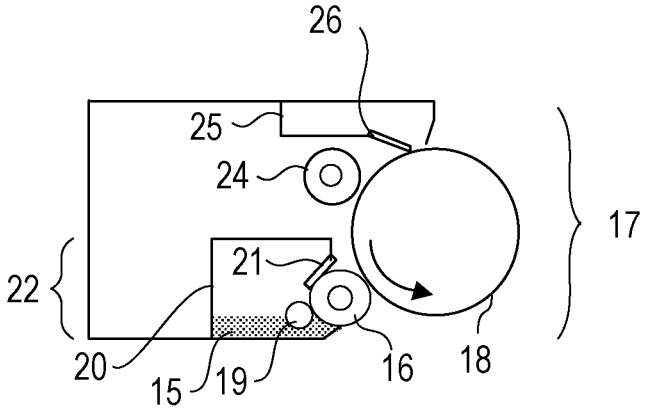
FIG. 3 is a schematic diagram of the structure of a process cartridge according to an embodiment of the present disclosure.

FIG. 3 is a schematic view of a process cartridge. The process cartridge 17 shown in FIG. 3 is configured to be removably attached to the body of an electrophotographic apparatus. The process cartridge 17 includes a developing roller 16, a developing blade 21, a developing unit 22, a photosensitive member 18, a cleaning blade 26, a waste toner container 25, and a charging roller 24. The developing unit 22 includes a toner container 20, and the toner container 20 contains a toner 15. The toner 15 in the toner container 20 is fed to the surface of the developing roller 16 by a toner feed roller 19, and is then formed into a layer having a predetermined thickness on the surface of the developing roller 16 by the developing blade 21.

Figure 4:
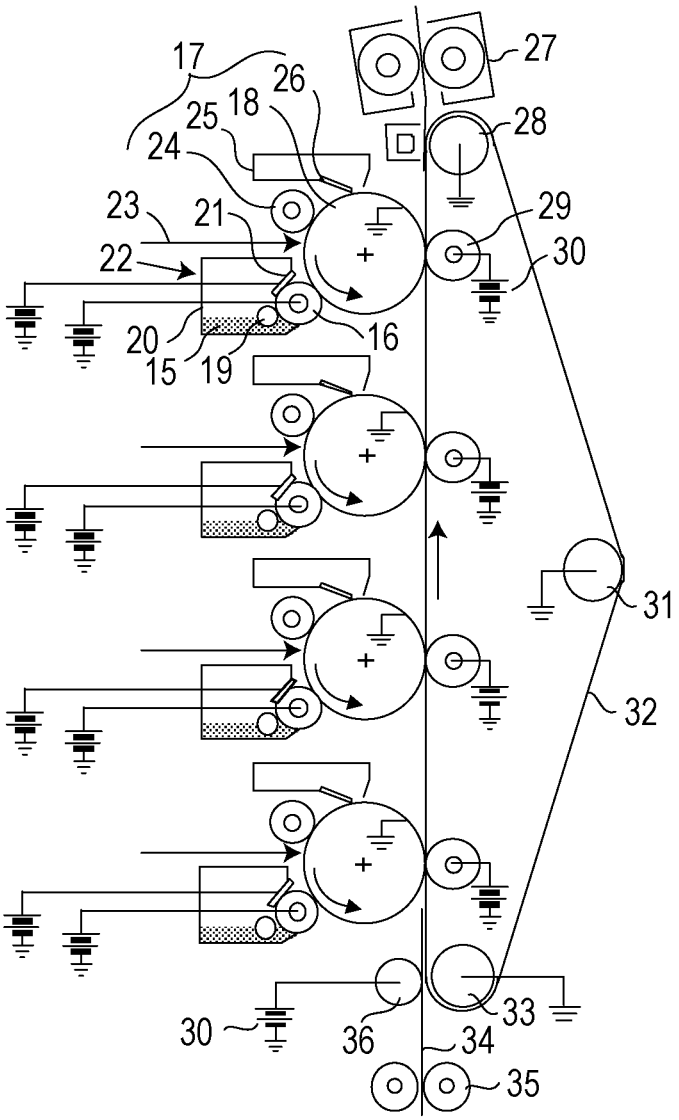
FIG. 4 is a schematic diagram of the structure of an electrophotographic apparatus according to an embodiment of the present disclosure.

FIG. 4 is a sectional view of an electrophotographic apparatus. To the electrophotographic apparatus shown in FIG. 4, a developing unit 22 including a developing roller 16, a toner feed roller 19, a toner container 20, and a developing blade 21 is removably attached. A process cartridge 17 is also attached, including a photosensitive member 18, a cleaning blade 26, a waste toner container 25, and a charging roller 24.

The electrophotographic apparatus may be directly provided with the photosensitive member 18, the cleaning blade 26, the waste toner container 25, and the charging roller 24. The photosensitive member 18 is rotated in the direction indicated by the arrow and is uniformly charged by the charging roller 24 adapted to charge the photosensitive member 18, and an electrostatic latent image is formed on the surface of the photosensitive member 18 by irradiation with a laser beam 23 from an exposure device. The electrostatic latent image is developed into a visible toner image by receiving a toner 15 from the developing unit 22 disposed in contact with the photosensitive member 18.

This electrophotographic apparatus performs what is called reversal development, in which toner images are formed in exposed areas. The visible toner image on the photosensitive member 18 is transferred to a recording medium, such as a paper sheet 34, by a transfer member, such as a transfer roller 29. The paper sheet 34 is fed into the electrophotographic apparatus via feed rollers 35 and an attraction roller 36 and conveyed to the position between the photosensitive member 18 and the transfer roller 29 by an endless transfer conveyance belt 32. The transfer conveyance belt 32 is operated by a driving roller 28, a driven roller 33, and a tension roller 31. A voltage is applied to the transfer rollers 29 and the attraction roller 36 from a bias source 30. The paper sheet 34 to which a toner image has been transferred is subjected to fixing operation of a fixing device 27 and ejected. Thus a printing operation is completed.

The portion of the toner remaining on the photosensitive member 18 without being transferred is scraped out with the cleaning blade 26, which is a cleaning member adapted to clean the surface of the photosensitive member 18. The scraped waste toner is transferred into the waste toner container 25, and the cleaned photosensitive member 18 is repeatedly operated as above. The developing unit 22 includes the toner container 20 containing a toner 15 as a one-component developer, and the developing roller 16, which is a developer bearing member, disposed in an opening of the toner container 20 at an end in the longitudinal direction of the toner container 20 so as to oppose the photosensitive member 18. The developing unit 22 is configured to develop an electrostatic latent image on the photosensitive member 18 into a visible image.

The electrophotographic member of the preset disclosure can be used as at least one of the electroconductive rollers, such as the developing roller, the transfer roller, and the charging roller, the developing blade, and the cleaning blade, of the process cartridge and the electrophotographic apparatus. The developing roller of the process cartridge and the electrophotographic apparatus must have an even, stable electrical conductivity even if the operational environment is changed. The electrophotographic member of the present disclosure is suitable as such a developing roller.

The electrophotographic member according to an embodiment of the present disclosure has an electric resistance that does not vary much even when it is repeatedly exposed to a variety of environments. Accordingly, the electrophotographic member contributes to stably forming high-quality electrophotographic images. Also, the process cartridge and the electrophotographic apparatus according to another embodiment of the present disclosure can stably form high-quality electrophotographic images.

EXAMPLES

Examples of the subject matter of the present disclosure and comparative examples will be described below.

Synthesis of Unmodified Polyrotaxane

Preparation of Pseudopolyrotaxane

The following compounds were mixed and dissolved in 40 mL of water of 80° C. by being stirred.

- 3.5 g of α-cyclodextrin (produced by Tokyo Chemical Industry)
- 14.0 g of polyethylene glycol having amino groups at both ends (Poly(ethyleneglycol) bis(amine) produced by Sigma-Aldrich, Mw=20000)

The resulting solution was cooled and allowed to stand at a temperature of 5° C. for 16 hours to precipitate white paste precipitate. The paste was dehydrated by freeze drying to yield pseudopolyrotaxane. In this operation, the amount of cyclic molecule surrounding the linear-chain molecule, can be controlled by varying the mixing time and the mixing temperature.

In the following description, α-cyclodextrin may be abbreviated as α-CD. Also, polyethylene glycol may be abbreviated as PEG.

Preparation of Polyrotaxane PR-01

To the pseudopolyrotaxane obtained in the above operation were added the following materials:

- 2.6 mL of diisopropylethylamine (produced by Tokyo Chemical Industry);
- 2.9 g of adamantane acetic acid (produced by Tokyo Chemical Industry);
- 2.1 g of 1-hydroxybenzotriazole (produced by Tokyo Chemical Industry);
- 6.2 g of benzotriazole-1-yloxytris(dimethylamino) phosphonium hexafluorophosphate (BOP reagent, produced by Wako Pure Chemical Industries); and 102.2 mL of a solution of dry dimethylformamide (DMF).

The mixture was subjected to a reaction at 5° C. for 24 hours in an argon-purged atmosphere.

Then, 75 mL of methanol was added to the mixture, and centrifugal separator was performed. Furthermore, the reaction product was washed with a solvent prepared by mixing methanol and DMF in the same proportion and 100 mL of methanol two times each and subjected to centrifugal separation, followed by vacuum drying. The resulting solid was dissolved in 75 mL of dimethyl sulfoxide (DMSO), and the solution was dripped into 500 mL of water to yield precipitate. The precipitate was subjected to centrifugal separation, and the supernatant liquid was removed. After being washed with 200 mL of water and 200 mL of methanol, the precipitate was vacuum-dried to yield 5.0 g of polyrotaxane (PR-01) blocked with adamantane groups at both ends thereof.

The resulting polyrotaxane PR-01 was subjected to NMR analysis, and the number of α-CD cyclic molecules was about 61. The calculated maximum number of α-CD cyclic molecules threaded with PEG was 230. Hence, in the present Example, the proportion of the number of α-CD molecules of the polyrotaxane was 0.27 to the maximum number of α-CD molecules.

Synthesis of Modified Polyrotaxane PR-02

In 10 mL of dehydrated DMSO was dissolved 1.0 g of polyrotaxane PR-01 synthesized above. To this solution was added 1.9 g (corresponding to 12 equivalents to 18 equivalents of hydroxy groups of α-CD molecules of the polyrotaxane) of sodium methoxide (25% solution in methanol). The resulting suspension was stirred for 6 hours while methanol was being removed under reduced pressure. After adding 1.8 g of iodohexane (E-1) as an electrophile to the suspension, the reaction solution was stirred for 24 hours and then diluted to 100 mL with purified water. The diluted solution was dialyzed using a dialysis tube (cut-off molecular weight: 10000) for 48 hours in tap water flow. Furthermore, 4-hour dialysis was performed twice in 500 mL of purified water, and the product was freeze-dried to yield 1.25 g of polyrotaxane PR-02 having a structure in which some of the off groups of α-CD were substituted with $O(CH_2)_5CH_3$. The resulting polyrotaxane PR-02 was subjected to NMR analysis. The calculated percentage of hexyl groups introduced was 59%.

Synthesis of Modified Polyrotaxanes PR-03 to PR-09

Modified polyrotaxanes PR-03 to PR-09 were synthesized in the same manner as modified polyrotaxane PR-02, except that the electrophile shown in Table 1 and the weight thereof added were changed to those shown in Table 2.

TABLE 1

| | Electrophile |
|---|---|
| E-1 | Iodohexane (produced by Tokyo Chemical Industry) |
| E-2 | Iodomethane (produced by Tokyo Chemical Industry) |
| E-3 | 1-(Bromoethyl)-1-butylcyclohexane (produced by Aldlab Chemicals, LLC) |
| E-4 | 1-(2-Iodoethoxy) butane (produced by Aurora Fine Chemicals LLC) |
| E-5 | Allyl chloride (produced by Tokyo Chemical Industry) |
| E-6 | 3-Butenyl chloride (produced by BOC) |
| E-7 | 1-Bromo-2-propanol (produced by Tokyo Chemical Industry) |
| E-8 | 6-Iodo-1-hexene (produced by Sigma Aldrich) |
| E-9 | Allyl chloromethyl ether (produced by American Custom Chemicals) |
| E-10 | Pentenoic acid (produced by Tokyo Chemical Industry) |
| E-11 | 1-(2-Bromoethyl)-1-ethenylcyclohexane (produced by FCH Group) |

Synthesis of Modified Polyrotaxane PR-10

In 20 mL of benzene was dissolved 1 g of polyrotaxane PR-09 synthesized above, and 0.6 g of 1-propanethiol (produced by Tokyo Chemical Industry) was added to the solution. The resulting solution was subjected to a reaction at 80° C. for 3 hours in a nitrogen atmosphere. The resulting reaction liquid was dropped into methanol to precipitate a solid, and the solid was centrifuged. The solid was washed with 200 mL of water and then dried to yield 0.94 g of polyrotaxane PR-10 having a structure in which some of the allyl groups of α-CD of polyrotaxane PR-09 were substituted with propanethiol groups. The percentage of propanethiol groups introduced was 13% to the allyl groups of polyrotaxane PR-09.

Synthesis of Modified Polyrotaxane PR-11

In 50 g of 8% solution of lithium chloride in N,N-dimethylacetamide was dissolved 1.0 g of polyrotaxane PR-01. To the resulting solution were added 6.5 g of acetic anhydride, 5.1 g of pyridine, and 99 mg of N,N-dimethylaminopyridine, and the mixture was subjected to a reaction by being stirred at room temperature overnight. The resulting reaction liquid was dropped into ethanol to precipitate a solid, and the solid was centrifuged. The obtained solid was vacuum-dried and then dissolved in acetone. The resulting solution was dropped into water to precipitate a solid, and the solid was centrifuged. The obtained solid was washed with 200 mL of water twice and then dried to yield 1.12 g of polyrotaxane PR-11 having a structure in which some of the OH groups of α-CD of polyrotaxane PR-01 were substituted with $OCOCH_3$. The percentage of $OCOCH_3$ introduced was 73% to all the OH groups of the cyclic molecules of polyrotaxane PR-01.

Synthesis of Modified Polyrotaxanes PR-12 to PR14, PR-17, PR-24 to PR-32, and PR-39 to PR-42

Modified polyrotaxanes PR-12 to PR-14, PR-17, PR-24 to PR-32, and PR-39 to PR-42 were synthesized in the same manner as modified polyrotaxane PR-02, except that the polyrotaxane used as the precursor for synthesis and the electrophile were replaced with those shown in Table 3. The percentage of the substituent introduced was calculated with respect to all the OH groups of the cyclic molecules of the polyrotaxane used as the precursor.

TABLE 2

| | | Modified polyrotaxane | | | | | | | |
|---|---|---|---|---|---|---|---|---|---|
| | | PR-02 | PR-03 | PR-04 | PR-05 | PR-06 | PR-07 | PR-08 | PR-09 |
| Polyrotaxane as precursor | No. | PR-01 | PR-01 | PR-01 | PR-01 | PR-01 | PR-01 | PR-01 | PR-01 |
| | Weight (g) | 1.0 | 1.0 | 1.0 | 1.0 | 1.0 | 1.0 | 1.0 | 1.0 |
| Electrophile | No. | E-1 | E-1 | E-1 | E-2 | E-3 | E-4 | E-4 | E-5 |
| | Weight (g) | 1.8 | 3.5 | 0.5 | 1.2 | 1.8 | 2.1 | 4.1 | 0.9 |
| Substitution (%) | | 59 | 78 | 11 | 63 | 13 | 56 | 81 | 58 |

TABLE 3

| | | Modified polyrotaxane | | | | | | | | |
|---|---|---|---|---|---|---|---|---|---|---|
| | | PR-12 | PR-13 | PR-14 | PR-17 | PR-24 | PR-25 | PR-26 | PR-27 | PR-28 |
| Polyrotaxane as precursor | No. | PR-02 | PR-03 | PR-04 | PR-01 | PR-02 | PR-10 | PR-07 | PR-08 | PR-07 |
| | Weight (g) | 1.0 | 1.0 | 1.0 | 1.0 | 1.0 | 1.0 | 1.0 | 1.0 | 1.0 |
| Electrophile | No. | E-5 | E-5 | E-5 | E-5 | E-8 | E-8 | E-8 | E-8 | E-8 |
| | Weight (g) | 5.0 | 6.1 | 0.8 | 0.9 | 13.7 | 13.7 | 13.7 | 13.7 | 7.1 |
| Substitution (%) | | 18 | 17 | 7 | 58 | 7 | 13 | 11 | 20 | 5 |

| | | Modified polyrotaxane | | | | | | | |
|---|---|---|---|---|---|---|---|---|---|
| | | PR-29 | PR-30 | PR-31 | PR-32 | PR-39 | PR-40 | PR-41 | PR-42 |
| Polyrotaxane as precursor | No. | PR-05 | PR-02 | PR-10 | PR-11 | PR-10 | PR-11 | PR-02 | PR-07 |
| | Weight (g) | 1.0 | 1.0 | 1.0 | 1.0 | 1.0 | 1.0 | 1.0 | 1.0 |
| Electrophile | No. | E-8 | E-9 | E-9 | E-9 | E-11 | E-11 | E-11 | E-11 |
| | Weight (g) | 13.7 | 6.9 | 6.9 | 6.9 | 14.1 | 14.1 | 14.1 | 14.1 |
| Substitution (%) | | 16 | 14 | 7 | 13 | 11 | 18 | 13 | 14 |

Synthesis of Modified Polyrotaxane PR-15

In 10 mL of dehydrated DMSO was dissolved 1.0 g of polyrotaxane PR-06. To this solution was added 1.6 g (corresponding to 12 equivalents to 18 equivalents of hydroxy groups of α-CD molecules of the polyrotaxane) of sodium methoxide (25% solution in methanol). The resulting suspension was stirred for 6 hours while methanol was being removed under reduced pressure. After adding 1.0 g of 3-butenyl chloride (E-6) as an electrophile to the suspension, the reaction solution was stirred for 24 hours and then diluted to 100 mL with purified water. The diluted solution was dialyzed using a dialysis tube (cut-off molecular weight: 10000) for 48 hours in tap water flow. Furthermore, 4-hour dialysis was performed twice in 500 mL of purified water. After being freeze-dried, the product was dissolved in 20 mL of benzene. Then, 0.8 g of 1,4-butanediol (produced by Tokyo Chemical Industry) was added, and the resulting solution was stirred at 70° C. for 3 hours in a nitrogen atmosphere. The reaction liquid was dropped into methanol to precipitate a solid, and the solid was centrifuged. The solid was washed with 200 mL of water and then dried to yield 1.01 g of polyrotaxane PR-15 having a structure in which some of the hydroxy groups of polyrotaxane PR-06 were substituted with dimercaptobutyl groups. The percentage of dimercaptobutyl groups introduced was 23% to the hydroxy groups of polyrotaxane PR-06.

Synthesis of Modified Polyrotaxane PR-16

Modified polyrotaxane PR-16 was synthesized in the same manner as modified polyrotaxane PR-15, except that 1.0 g of polyrotaxane PR-07 and 3.0 g of electrophile were used. The percentage of dimercaptobutyl groups introduced was 31%.

Synthesis of Modified Polyrotaxane PR-18

In 20 mL of dehydrated dimethyl sulfoxide (DMSO) was dissolved 1.0 g of polyrotaxane PR-02. To this solution was added 0.34 g (corresponding to 18 equivalents to 18 equivalents of hydroxy groups of α-CD molecules of the polyrotaxane) of sodium hydride. The resulting suspension was stirred for 4 hours while DMSO was being removed under reduced pressure. After adding 1.2 g of 1-bromo-2-propanol (E-7) as an electrophile to the suspension, the reaction solution was stirred for 12 hours and then diluted to 100 mL with purified water. The diluted solution was dialyzed using a dialysis tube (cut-off molecular weight: 10000) for 48 hours in tap water flow. Furthermore, 4-hour dialysis was performed twice in 500 mL of purified water, and the product was freeze-dried to yield a polyrotaxane PR-18 precursor. Then, the precursor was dissolved again in 10 mL of dehydrated DMSO, and to this solution was added 0.34 g of sodium hydride. The resulting suspension was stirred for 4 hours. After adding 0.7 g of allyl chloride (E-5) as an electrophile to the suspension, the reaction solution was stirred for 12 hours and then diluted to 100 mL with purified water. The reaction solution was dialyzed and dried in the same manner as in the purification of the precursor, and thus modified polyrotaxane PR-18 was obtained, having a structure in which some of the OH groups of α-cyclodextrin of polyrotaxane PR-02 were substituted with $—OCH_2CH(CH_3)OCH_2CH{=}CH_2$. The yield was 1.03 g, and the percentage of the substituent introduced was 14%.

Synthesis of Modified Polyrotaxanes PR-19 to PR-23

Modified polyrotaxanes PR-19 to PR-23 were synthesized in the same manner as modified polyrotaxane PR-18, except that the polyrotaxane used for synthesis was replaced with that shown in Table 4. For modified polyrotaxane PR-21, the stirring time after adding electrophile 1 was 36 hours, and the stirring time after adding electrophile 2 was 24 hours. The percentage of the substituent introduced was calculated with respect to all the OH groups of the cyclic molecules of the precursor of the modified polyrotaxane.

TABLE 4

| | | Modified polyrotaxane | | | | | |
|---|---|---|---|---|---|---|---|
| | | PR-18 | PR-19 | PR-20 | PR-21 | PR-22 | PR-23 |
| Polyrotaxane as precursor | No. | PR-02 | PR-06 | PR-06 | PR-06 | PR-07 | PR-11 |
| | Weight (g) | 1.0 | 1.0 | 1.0 | 1.0 | 1.0 | 1.0 |
| Electrophile1 | No. | E-7 | E-7 | E-7 | E-7 | E-7 | E-7 |
| | Weight (g) | 1.2 | 0.9 | 2.0 | 20.0 | 2.0 | 2.0 |
| Electrophile2 | No. | E-5 | E-5 | E-5 | E-5 | E-5 | E-5 |
| | Weight (g) | 0.7 | 0.4 | 0.8 | 8.0 | 0.8 | 0.8 |
| Substitution (%) | | 14 | 4 | 10 | 80 | 21 | 18 |

Synthesis of Modified Polyrotaxane PR-33

To 4.3 g of ϵ-caprolactone (produced by Kishida Chemical) was added 1.0 g of modified polyrotaxane PR-06 while the solvent was heated to 80° C. The resulting mixture was stirred at 110° C. for an hour with blowing dry nitrogen. Then, 0.03 g of 50 wt % solution of tin (II) 2-ethylhexanoate in hexane was added, and the mixture was stirred at 130° C. for 6 hours. Then, the reaction liquid was dropped into ethanol to precipitate a solid, and the solid was centrifuged. The obtained solid was vacuum-dried and then dissolved in acetone. The resulting solution was dropped into water to precipitate a solid, and the solid was centrifuged. The obtained solid was washed with 200 mL of water twice and then dried. The dried solid was dissolved in 10 mL of dehydrated DMSO, and 0.8 g of sodium methoxide (25% solution in methanol) was added. The resulting suspension was stirred for 6 hours while methanol was being removed under reduced pressure. After adding 0.5 g of 3-butenyl chloride (E-6) as an electrophile to the suspension, the reaction solution was stirred for 24 hours and then diluted to 100 mL with purified water. The diluted solution was dialyzed using a dialysis tube (cut-off molecular weight: 10000) for 48 hours in tap water flow. Furthermore, 4-hour dialysis was performed twice in 500 mL of purified water, and the product was dried to yield 1.02 g of polyrotaxane PR-33 having a structure in which some of the OH groups of α-CD of modified polyrotaxane PR-06 were substituted with —$OCO(CH_2)_4COCH_2CH{=}CH_2$. The percentage of the substituent introduced was 13% to all the OH groups of the cyclic molecules of modified polyrotaxane PR-06.

Synthesis of Modified Polyrotaxanes PR-34 and PR-35

Modified polyrotaxanes PR-34 and PR-35 were synthesized in the same manner as modified polyrotaxane PR-33, except that the polyrotaxane used for synthesis was replaced with that shown in Table 5.

TABLE 5

| Modified polyrotaxane | | PR-33 | PR-34 | PR-35 |
|---|---|---|---|---|
| Polyrotaxane as precursor | No. | PR-06 | PR-07 | PR-01 |
| | Weight (g) | 1.0 | 1.0 | 1.0 |
| Electrophile1 | No. | E-7 | E-7 | E-7 |
| | Weight (g) | 1.9 | 1.9 | 2.0 |
| Electrophile2 | No. | E-5 | E-5 | E-5 |
| | Weight (g) | 0.7 | 0.7 | 0.8 |
| Substitution (%) | | 13 | 17 | 36 |

Synthesis of Modified Polyrotaxane PR-36

In 30 mL of dehydrated DMSO was dissolved 1 g of modified polyrotaxane PR-12. To this solution was added 1.0 g of potassium iodide, and the mixture was heated at 80° C. for 3 hours with stirring. Then, the reaction liquid was diluted to 100 mL with purified water. The diluted solution was dialyzed using a dialysis tube (cut-off molecular weight: 10000) for 48 hours in tap water flow. Furthermore, 4-hour dialysis was performed twice in 500 mL of purified water, and the product was freeze-dried to yield a polyrotaxane PR-36 precursor. The polyrotaxane PR-36 precursor was added to the solution made up of 6.5 g of pentenoic acid (E-10) and 50 mL of 0.1 mol/L solution of sodium hydroxide in water. The mixture was stirred for 12 hours, and the resulting reaction solution was diluted to 100 mL with purified water. This solution was dialyzed and dried in the same manner as in the purification of the precursor, and thus modified polyrotaxane PR-36 was obtained, having a structure in which some of the allyl groups bound to α-cyclodextrin of polyrotaxane PR-12 were substituted with —$OCH(CH_3)OCOCH_2CH{=}CH_2$. The yield was 0.97 g, and the percentage of the substituent introduced was 11%. The percentage of the substituent introduced was calculated with respect to all the allyl groups of polyrotaxane PR-12.

Synthesis of Modified Polyrotaxane PR-37

In 50 g of 8% solution of lithium chloride in N,N-dimethylacetamide was dissolved 1 g of polyrotaxane PR-05. To the resulting solution were added 5.5 g of allyl chloride (E-5) as an electrophile, 5.1 g of pyridine, and 99 mg of N,N-dimethylaminopyridine, and the mixture was stirred at room temperature overnight. The reaction liquid was dropped into ethanol to precipitate a solid, and the solid was centrifuged. The obtained solid was vacuum-dried and then dissolved in acetone. The resulting solution was dropped into water to precipitate a solid, and the solid was centrifuged. The obtained solid was washed with 200 mL of water twice and then centrifuged and dried to yield a polyrotaxane PR-37 precursor having a structure in which some of the OH groups of α-CD were substituted with —$OCH_2CH{=}CH_2$. The percentage of the substituent introduced was 15%. The precursor was dissolved in 30 mL of dehydrated DMSO, and 1.0 g of potassium iodide was added to the solution. The mixture was stirred at 80° C. for 3 hours, and the resulting reaction solution was diluted to 100 mL with purified water. The diluted solution was dialyzed using a dialysis tube (cut-off molecular weight: 10000) for 48 hours in tap water flow. Furthermore, 4-hour dialysis was performed twice in 500 mL of purified water, and the product was freeze-dried. The obtained solid was added to the solution made up of 6.5 g of pentenoic acid (E-10) and 50 mL of 0.1 mol/L solution of sodium hydroxide in water. The mixture was stirred for 12 hours, and the resulting reaction solution was diluted to 100 mL with purified water. This solution was dialyzed and dried in the same manner as in the purification of the precursor, and thus modified polyrotaxane PR-37 was obtained, having a structure in which some of the allyl groups bound to α-cyclodextrin of polyrotaxane PR-05 were substituted with —$OCH_2CH(CH_3)OCOCH_2CH_2CH{=}CH_2$. The yield was 0.97 g, and the percentage of the substituent introduced was 11%. The percentage of the substituent introduced was calculated with respect to all the allyl groups of the polyrotaxane PR-37 precursor.

Synthesis of Modified Polyrotaxane PR-38

Modified polyrotaxane PR-38 was synthesized in the same manner as modified polyrotaxane PR-37, except that the polyrotaxane used for synthesis was replaced with that shown in Table 6. The percentage of the substituent introduced was calculated with respect to all the allyl groups of the polyrotaxane PR-38 precursor.

TABLE 6

| Modified polyrotaxane | | PR-37 | PR-38 |
|---|---|---|---|
| Modified polyrotaxane as precursor | No. | PR-05 | PR-06 |
| | Weight (g) | 1.0 | 1.0 |
| Electrophile1 | No. | E-5 | E-5 |
| | Weight (g) | 5.5 | 5.4 |
| Allyl substitution (%) | | 15 | 17 |
| Electrophile2 | No. | E-10 | E-10 |
| | Weight (g) | 6.5 | 6.6 |
| *Substitution (%) | | 11 | 13 |

*Percentage of substituents derived from Electrophile 2 to allyl groups

Preparation of Substrate 12

A primer DY35-051 (produced by Dow Corning Toray) was applied onto a stainless steel (SUS 304) core bar of 6 mm in diameter and burned at 180° C. for 20 minutes in an oven. Thus a substrate 12 as an axial bar was formed.

Preparation of Elastic Roller D-1

The liquid silicone rubber material and the carbon black, shown Table 7 were mixed together so that the carbon black particles are dispersed in the liquid silicone rubber material, thus preparing a liquid material for forming an elastic layer. The resulting liquid material was poured into a cavity in a die in which the substrate 12 is placed, and was cured by being heated at 140° C. for 20 minutes in an oven. After cooling the die, the axial bar coated with the silicone rubber layer was taken out of the die and heated at 190° C. for 3 hours in an oven for curing the silicone rubber layer. Thus, elastic roller D-1 of 12 mm in diameter was prepared, which includes the substrate 12 and the silicon rubber elastic layer over the periphery of the substrate.

TABLE 7

| | |
|---|---|
| Liquid silicone rubber material: SE 6905 A & B produced by Dow Corning Toray | 100 parts by mass |
| Carbon black: Tokablack #4300 produced by Tokai Carbon | 15 parts by mass |

Preparation of Elastic Roller D-2

The materials shown in Table 8 were mixed using a pressure kneader to yield A-kneaded rubber composition 1.

TABLE 8

| | |
|---|---|
| NBR rubber material: Nipol ™ DN219 produced by Zeon | 100 parts by mass |
| Carbon black: Tokablack #7360 SB produced by Tokai Carbon | 40 parts by mass |
| Calcium carbonate: NANOX #30 produced by Maruo Calcium | 20 parts by mass |
| Stearic acid: Stearic Acid S produced by Kao | 1 part by mass |
| Zinc oxide | 5 parts by mass |

Then, 77 parts by mass of A-kneaded rubber composition 1 was mixed with the materials shown in Table 9 on an open roll to yield unvulcanized rubber composition 1.

TABLE 9

| | |
|---|---|
| Sulfur: Sulfax 200S produced by Tsurumi Chemical | 1.2 parts by mass |
| Tetrabenzylthiuram disulfide: SANCELER TBZTD produced by Sanshin Chemical Industry | 4.5 parts by mass |

Unvulcanized rubber composition 1 was extruded onto the substrate 12 to form an unvulcanized rubber elastic layer 2, by using a cross-head extruder. The unvulcanized rubber elastic layer 2 was cured by being heated at 160° C. for 70 minutes in an oven. Then, the surface of the elastic layer was polished with a rotary grindstone. Thus, elastic roller D-2 was prepared, whose diameter was 8.5 mm at the center in the length direction and 8.4 mm at positions of 90 mm from the center.

Preparation of Surface Layer Paint T-1

The method of manufacturing an electrophotographic member according to the present disclosure will now be described.

For forming an electroconductive resin layer 14, a mixture was prepared by mixing and stirring the following materials:

modified polyrotaxane PR-12: 100 parts by mass;

dithiol (KarenzMT® BD 1, produced by Showa Denko): 19.7 parts by mass

Terminal diacrylate (A-BPP-3, produced by Shin-Nakamura Chemical): 33.7 parts by mass;

radical photopolymerization initiator (IRGACURE® 184 produced by BASF): 5.1 parts by mass;

carbon black (MA 230, produced by Mitsubishi Chemical): 23.2 parts by mass; and

Urethane resin fine particles (Art Pearl C-800, produced by Negami Chemical Industrial): 10.0 parts by mass.

Subsequently, methyl ethyl ketone was added to the mixture with a proportion of 30% by mass to the total mass of solids and mixed together with a sand mill. Then, an appropriate amount of methyl ethyl ketone was further added to adjust the viscosity of the mixture to 10 cps to 12 cps, and thus surface layer paint T-1 was prepared.

Preparation of Surface Layer Paints T-2 to T-52

Surface layer paints T-2 to T-52 were prepared in the same manner as surface layer paint T-1 except that the polyrotaxane, the crosslinking agent shown in Table 10, the polymerization initiator shown in Table 11, the electroconductivity imparting agent shown in Table 12, and the urethane resin particles were replaced, including the amounts used, according to Tables 13A to 13D.

TABLE 10

| | Binding agent |
|---|---|
| A-1 | Dithiol: KarenzMT ® BD 1 (produced by Showa Denko) |
| A-2 | Terminal diacrylate: A-BPP-3 (produced by Shin-Nakamura Chemical) |
| A-3 | Urethane acrylate: UA-306T (produced by Kyoeisha Chemical) |
| A-4 | Polyethylene glycol diacrylate: A-600 (produced by Shin-Nakamura Chemical) |
| A-5 | Polyisocyanate: Coronate ® 2233 (produced by Tosoh) |
| A-6 | Cyanuric chloride (produced by Nacalai Tesque) |
| A-7 | Toluene diisocyanate: Coronate ® T-80 (produced by Tosoh) |
| A-8 | Polyoxytetramethylene glycol: PTMG 3000 (produced by Mitsubishi Chemical) |
| A-9 | Monofunctional acrylate: AM-90G (produced by Shin-Nakamura Chemical) |
| A-10 | Monofunctional methacrylate: M-230G (produced by Shin-Nakamura Chemical) |

TABLE 11

| | Polymerization initiator |
|---|---|
| B-1 | IRGACURE ® 184 (produced by BASF) |
| B-2 | OT-azo 15 (produced by Otsuka Chemical) |
| B-3 | 1N sodium hydroxide aqueous solution (produced by Kishida Chemical) |

TABLE 12

| | Conducting agent |
|---|---|
| C-1 | MA 230 (Carbon black) (produced by Mitsubishi Chemical) |
| C-2 | TMPA-TSFI (Ionic liquid) (produced by Kanto Chemical) |
| C-3 | ITO (Indium tin-based oxide) (produced by Mitsubishi Chemical) |

TABLE 13A

| | | Surface layer paint | | | | | | |
|---|---|---|---|---|---|---|---|---|
| | | T-1 | T-2 | T-3 | T-4 | T-5 | T-6 | T-7 |
| Modified polyrotaxane | No. | PR-12 | PR-13 | PR-14 | PR-15 | PR-16 | PR-17 | PR-18 |
| | Weight (g) | 100 | 100 | 100 | 100 | 100 | 100 | 100 |
| Binding agent 1 | No. | A-1 | A-1 | A-1 | A-3 | A-3 | A-1 | A-1 |
| | Weight (g) | 19.7 | 12.2 | 16.7 | 54.4 | 65.0 | 41.3 | 11.7 |
| Binding agent 2 | No. | A-2 | A-2 | A-2 | — | — | A-2 | A-2 |
| | Weight (g) | 33.7 | 21.0 | 28.6 | — | — | 71.0 | 20.0 |
| Radical initiator | No. | B-1 | B-1 | B-1 | B-1 | B-1 | B-1 | B-1 |
| | Weight (g) | 5.1 | 5.0 | 5.0 | 5.1 | 5.0 | 5.0 | 5.2 |
| Conducting agent | No. | C-1 | C-1 | C-1 | C-2 | C-2 | C-1 | C-1 |
| | Weight (g) | 23.2 | 20.2 | 24.9 | 2.0 | 23.2 | 31.7 | 20.0 |
| Urethane particles (mass part) | | 18.2 | 16.2 | 16.1 | 18.2 | 19.4 | 24.8 | 15.6 |
| Total substitution (%) | | 63.0 | 81.7 | 11.0 | 39.4 | 40.0 | 58.0 | 62.1 |

| | | Surface layer paint | | | | | | |
|---|---|---|---|---|---|---|---|---|
| | | T-8 | T-9 | T-10 | T-11 | T-12 | T-13 | T-14 |
| Modified polyrotaxane | No. | PR-18 | PR-18 | PR-19 | PR-22 | PR-23 | PR-24 | PR-25 |
| | Weight (g) | 100 | 100 | 100 | 100 | 100 | 100 | 100 |
| Binding agent 1 | No. | A-1 | A-1 | A-1 | A-3 | A-3 | A-3 | A-4 |
| | Weight (g) | 11.7 | 11.7 | 46.0 | 39.5 | 30.0 | 44.4 | 54.2 |
| Binding agent 2 | No. | A-2 | A-2 | A-2 | — | — | — | — |
| | Weight (g) | 20 | 20.0 | 78.6 | — | — | — | — |
| Radical initiator | No. | B-1 | B-1 | B-1 | B-1 | B-1 | B-1 | B-2 |
| | Weight (g) | 5.1 | 5.0 | 5.1 | 4.9 | 5.1 | 5.1 | 8.0 |
| Conducting agent | No. | C-2 | C-3 | C-1 | C-2 | C-2 | C-2 | C-2 |
| | Weight (g) | 1.7 | 15.0 | 33.5 | 1.8 | 1.7 | 1.9 | 2.0 |
| Urethane particles (mass part) | | 15.6 | 15.6 | 26.1 | 16.5 | 15.4 | 17.0 | 18.5 |
| Total substitution (%) | | 62.1 | 62.1 | 16.5 | 31.3 | 77.9 | 61.9 | 24.3 |

TABLE 13B

| | | Surface layer paint | | | | | | |
|---|---|---|---|---|---|---|---|---|
| | | T-15 | T-16 | T-17 | T-18 | T-19 | T-20 | T-21 |
| Modified polyrotaxane | No. | PR-26 | PR-29 | PR-30 | PR-31 | PR-32 | PR-33 | PR-34 |
| | Weight (g) | 100 | 100 | 100 | 100 | 100 | 100 | 100 |
| Binding agent 1 | No. | A-1 | A-4 | A-1 | A-3 | A-1 | A-3 | A-1 |
| | Weight (g) | 24.8 | 92.4 | 19.9 | 42.7 | 25.0 | 88.4 | 30.8 |
| Binding agent 2 | No. | A-2 | — | A-2 | — | A-2 | — | A-2 |
| | Weight (g) | 42.5 | — | 34 | — | 42.8 | — | 52.6 |
| Radical initiator | No. | B-1 | B-2 | B-1 | B-1 | B-1 | B-1 | B-1 |
| | Weight (g) | 5.1 | 8.0 | 5.1 | 5.1 | 5.0 | 5.1 | 5.1 |
| Conducting agent | No. | C-1 | C-2 | C-1 | C-2 | C-1 | C-3 | C-1 |
| | Weight (g) | 25.2 | 2.5 | 23.2 | 1.9 | 25.2 | 20.7 | 27.5 |
| Urethane particles (mass part) | | 19.7 | 22.8 | 18.1 | 16.8 | 19.7 | 22.1 | 21.5 |
| Total substitution (%) | | 25.6 | 68.9 | 64.7 | 19.1 | 76.5 | 24.3 | 30.4 |

| | | Surface layer paint | | | | | | |
|---|---|---|---|---|---|---|---|---|
| | | T-22 | T-23 | T-24 | T-25 | T-26 | T-27 | T-28 |
| Modified polyrotaxane | No. | PR-35 | PR-36 | PR-37 | PR-38 | PR-39 | PR-40 | PR-41 |
| | Weight (g) | 100 | 100 | 100 | 100 | 100 | 100 | 100 |
| Binding agent 1 | No. | A-4 | A-4 | A-1 | A-4 | A-1 | A-4 | A-1 |
| | Weight (g) | 117.2 | 46.6 | 27.2 | 30.1 | 39.1 | 47.2 | 21.3 |
| Binding agent 2 | No. | — | — | A-2 | — | A-2 | — | A-2 |
| | Weight (g) | — | — | 46.4 | — | 66.8 | — | 36.5 |
| Radical initiator | No. | B-2 | B-2 | B-1 | B-2 | B-1 | B-2 | B-1 |
| | Weight (g) | 8.0 | 8.1 | 5.0 | 8.0 | 5.1 | 8.2 | 5.0 |
| Conducting agent | No. | C-3 | C-3 | C-1 | C-3 | C-2 | C-2 | C-2 |
| | Weight (g) | 23.8 | 16.1 | 26.1 | 14.3 | 2.6 | 1.9 | 2.0 |
| Urethane particles (mass part) | | 25.7 | 17.6 | 20.4 | 15.7 | 24.1 | 17.7 | 18.6 |
| Total substitution (%) | | 36.0 | 62.4 | 24.4 | 63.8 | 22.6 | 77.9 | 64.3 |

TABLE 13C

| | | Surface layer paint | | | | | | |
|---|---|---|---|---|---|---|---|---|
| | | T-29 | T-30 | T-31 | T-32 | T-33 | T-34 | T-35 |
| Modified polyrotaxane | No. | PR-36 | PR-09 | PR-17 | PR-17 | PR-02 | PR-01 | PR-06 |
| | Weight (g) | 100 | 100 | 100 | 100 | 50 | 50 | 100 |
| Binding agent 1 | No. | A-1 | A-4 | A-9 | A-10 | A-5 | A-5 | A-6 |
| | Weight (g) | 25.4 | 70.7 | 59.4 | 69.4 | 92.5 | 92.5 | 26.0 |
| Binding agent 2 | No. | A-2 | — | — | — | A-8 | A-8 | — |
| | Weight (g) | 43.5 | — | — | — | 50 | 50 | — |
| Radical initiator | No. | B-2 | B-1 | B-1 | B-1 | — | — | B-3 |
| | Weight (g) | 7.9 | 5.1 | 5.2 | 5.1 | — | — | 16.1 |
| Conducting agent | No. | C-2 | C-2 | C-1 | C-1 | C-1 | C-1 | C-2 |
| | Weight (g) | 2.0 | 2.2 | 30.2 | 23.2 | 28.1 | 28.1 | 1.8 |
| Urethane particles (mass part) | | 17.9 | 20.0 | 24.8 | 19.3 | 21.9 | 21.9 | 16.2 |
| Total substitution (%) | | 57.0 | 33.1 | 58.0 | 58.0 | 57.0 | 0.0 | 53.0 |

| | | Surface layer paint | | | | | | |
|---|---|---|---|---|---|---|---|---|
| | | T-36 | T-37 | T-38 | T-39 | T-40 | T-41 | T-42 |
| Modified polyrotaxane | No. | PR-11 | PR-10 | PR-08 | PR-12 | PR-15 | PR-16 | PR-18 |
| | Weight (g) | 100 | 75 | 100 | 100 | 100 | 100 | 100 |
| Binding agent 1 | No. | A-6 | A-7 | A-7 | A-1 | A-3 | A-3 | A-1 |
| | Weight (g) | 26.0 | 17.3 | 17.3 | 19.7 | 54.4 | 65 | 11.7 |
| Binding agent 2 | No. | — | A-8 | — | A-2 | — | — | A-2 |
| | Weight (g) | — | 75 | — | 33.7 | — | — | 20.0 |
| Radical initiator | No. | B-3 | — | — | B-1 | B-1 | B-1 | B-1 |
| | Weight (g) | 16.1 | — | — | 5.1 | 5.0 | 5.1 | 5.2 |
| Conducting agent | No. | C-3 | C-2 | C-1 | C-1 | C-2 | C-2 | C-1 |
| | Weight (g) | 13.8 | 2.1 | 23.2 | 23.2 | 2.0 | 2.1 | 20.0 |
| Urethane particles (mass part) | | 16.2 | 19.1 | 16.9 | 0.0 | 0.0 | 0.0 | 0.0 |
| Total substitution (%) | | 62.6 | 73.0 | 15.0 | 63.0 | 39.4 | 40.0 | 62.1 |

TABLE 13D

| | | Surface layer paint | | | | | | | | | |
|---|---|---|---|---|---|---|---|---|---|---|---|
| | | T-43 | T-44 | T-45 | T-46 | T-47 | T-48 | T-49 | T-50 | T-51 | T-52 |
| Modified polyrotaxane | No. | PR-19 | PR-20 | PR-21 | PR-32 | PR-24 | PR-26 | PR-27 | PR-02 | PR-11 | PR-10 |
| | Weight (g) | 100 | 50 | 25 | 100 | 100 | 100 | 78 | 50 | 100 | 75 |
| Binding agent 1 | No. | A-1 | A-1 | A-1 | A-1 | A-1 | A-1 | A-1 | A-5 | A-6 | A-7 |
| | Weight (g) | 46.0 | 46.0 | 92.0 | 25.0 | 24.8 | 24.8 | 72.6 | 92.5 | 26.0 | 17.3 |
| Binding agent 2 | No. | A-2 | A-2 | A-2 | A-2 | A-2 | A-2 | A-2 | A-8 | — | A-8 |
| | Weight (g) | 78.6 | 78.6 | 157.2 | 42.8 | 42.5 | 42.5 | 120.1 | 50.0 | — | 75.0 |
| Radical initiator | No. | B-1 | B-1 | B-1 | B-1 | — | — | B-3 | — | B-3 | — |
| | Weight (g) | 5.1 | 5.1 | 5.1 | 5.0 | 5.1 | 5.1 | 6.1 | — | 16.1 | — |
| Conducting agent | No. | C-1 | C-1 | C-1 | C-1 | C-1 | C-1 | C-1 | C-1 | C-3 | C-2 |
| | Weight (g) | 33.5 | 26.2 | 40.7 | 25.2 | 25.2 | 25.2 | 40.0 | 28.1 | 13.8 | 2.1 |
| Urethane particles (mass part) | | 0.0 | 0.0 | 0.0 | 0.0 | 0.0 | 0.0 | 0.0 | 0.0 | 0.0 | 0.0 |
| Total substitution (%) | | 16.5 | 21.7 | 82.6 | 19.7 | 61.9 | 25.6 | 84.8 | 57.0 | 62.6 | 73.0 |

Example 1

Elastic roller D-1 produced above was dipped in surface layer paint T-1 to form a coating film over the surface of the elastic layer of elastic roller D-1, followed by drying. The coating film was irradiated for 60 seconds with ultraviolet light with an illuminance of 800 mW from a high-pressure mercury-vapor lamp (manufactured by Ushio) from a distance of 10 cm while the roller was being rotated, thus forming a 15 μm-thick surface layer. Thus an electroconductive roller of Example 1 was produced. This electroconductive roller was examined for evaluation as below. For the following examinations, the conditions of the normal temperature, normal humidity environment (referred to as N/N environment) were 23.0° C. in temperature and 50% in relative humidity, and the conditions of the high-temperature, high-humidity environment (referred to as H/H environment) were 32.5° C. in temperature and 85% in relative humidity.

Evaluation as Electroconductive Roller

Electric Resistance

The resistance of the roller was measured in accordance with the following procedure after the roller was allowed to stand in the N/N environment and the H/H environment, each for 6 hours or more.

Measurement of Electric resistance in Early Stage

Figure 5A:
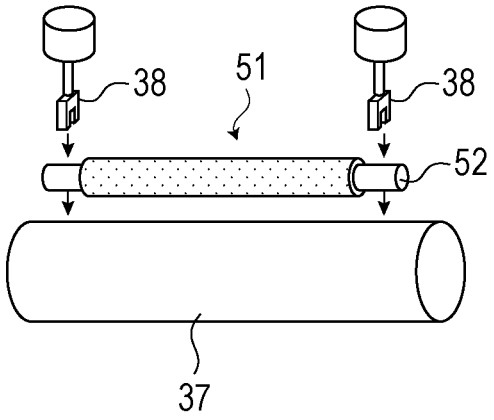
FIGS. 5A and 5B are illustrative representations of a measuring system for measuring the current of an electroconductive roller that is the electrophotographic member according to the present disclosure.
Figure 5B:
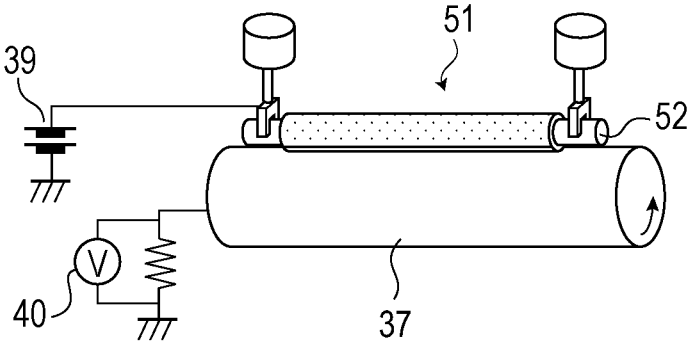

FIGS. 5A and 5B schematically show the test jig for examining variation in electric resistance.

Referring to FIG. 5A, while each end of an electroconductive axial bar 52 was being pressed at a load of 4.9 N with an electroconductive bearing 38, a metal columnar member 37 of 30 mm in diameter was rotated so that the electroconductive roller 51 was rotated at a rotational speed of 60 rpm.

Subsequently, as shown in FIG. 5B, a voltage of 50 V was applied from a high-voltage power supply 39, and the difference in potential was measured between the ends of a resistor having a known resistance (two or more digits lower than the electric resistance of the electroconductive roller) disposed between the metal columnar member 37 and the ground. For this measurement, 189 TRUE RMS MULTIMETER (manufactured by FLUKE) was used as a voltmeter 40. The current flowing to the metal columnar member through the electroconductive roller 51 was calculated from the potential difference measured and the electric resistance of the resistor. The electric resistance of the electroconductive roller 51 was determined by dividing the applied voltage 50 V by the current calculated.

The potential difference used for the calculation was the average of potential values measured for 3 seconds from 2 seconds after the start of voltage application. The obtained electric resistance was defined as the electric resistance in the early stage.

Measurement of Electric Resistance after Environmental Cycle Test

As an environmental cycle test, a test sample was allowed to stand in the N/N environment for 8 hours and subsequently in the H/H environment for 8 hours, and this environmental cycle was repeated 10 times. The electroconductive roller was subjected to such an environmental cycle test, and then the electric resistance after the environmental cycle test was measured in the same manner as the electric resistance in the early stage.

Frictional Charge Quantity of Roller

The frictional charge quantity of the electroconductive roller was measured in accordance with the following procedure after the roller was allowed to stand in the N/N environment and H/H environment each for 6 hours or more.

Figure 6:
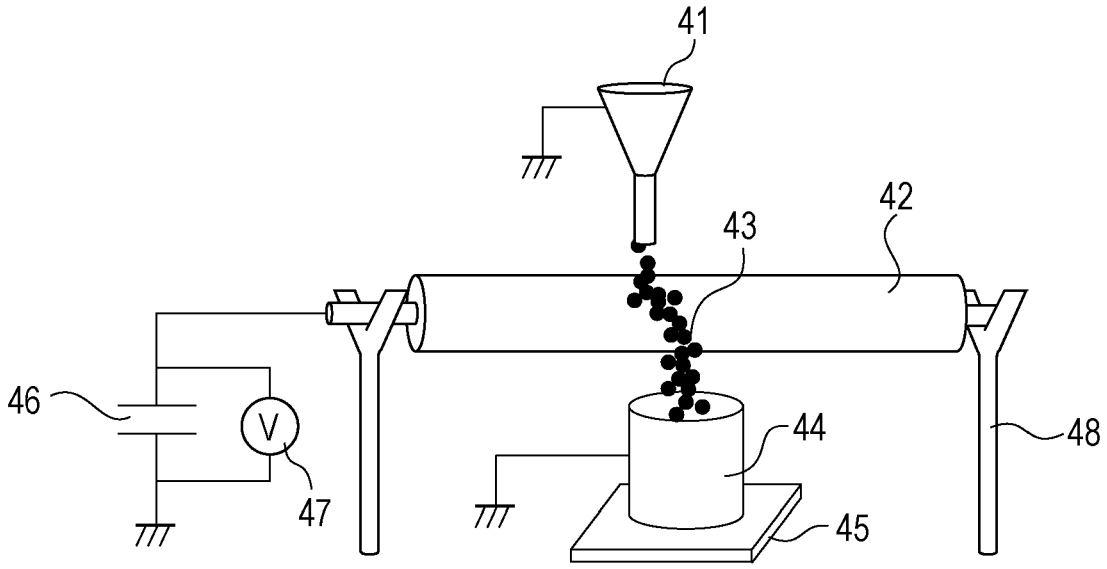
FIG. 6 is an illustrative representation of a measuring system for measuring the frictional charge quantity of a roller.

The test portion was connected to a cascade-type surface charge meter TS-100AT (manufactured by KYOCERA Chemical) for measurement as shown in FIG. 6. The electroconductive roller 42 was put between insulating support bars 48 as shown in FIG. 6. A carrier 43 was introduced into a powder inlet 41 and allowed to drop for 10 seconds, thereby being contact-charged. Standard carrier N-01 of the Imaging Society of Japan was used as the carrier. The total charge quantity Q (μC) of the carrier 43 dropped into a catch pan 44 on an insulating plate 45 was measured with a voltmeter 47 connected in parallel to a capacitor 46. Then, the mass (g) of the carrier in the catch pan 44 was measured, and the charge quantity per unit mass, Q/M (μC/g), was defined as frictional charge quantity 1 in the early stage.

Frictional Charge Quantity of Roller after Environmental Cycle Test

After the measurement of frictional charge quantity 1 in the early stage, the roller was subjected to the environmental cycle test in the same manner as in the measurement of the electric resistance after environmental cycle test. Then, frictional charge quantity 1 after the environmental cycle test was measured in the same manner as frictional charge quantity 1 in the early stage.

Evaluation as Developing Roller

Fogging Degree

For examining the degree of fogging, the electroconductive roller to be evaluated was mounted as a developing roller to a laser printer LBP 7700C manufactured by Canon and having the structure shown in FIG. 4. First, the laser printer provided with the developing roller was allowed to stand in the H/H environment for 6 hours. Subsequently, after a black pattern with a print coverage of 1% was intermittently printed on a predetermined number of copy paper sheets in such a manner that printing operation was suspended for 10 minutes every 100 sheets, a white solid pattern was printed on a new copy paper sheet, and the printer was stopped during the operation of printing the white solid pattern. The developer attached on the photosensitive member at this time was removed with a tape CT18 manufactured by Nichiban, and the reflectance of the developer on the tape was measured with a reflection densitometer TC-6DS/A manufactured by Tokyo Denshoku. The decrease (%) in reflectance was calculated with respect to the reflectance of the tape, and the result was defined as the fogging degree.

The fogging degree measured after printing the pattern with a print coverage of 1% on 100 sheets was defined as the fogging degree in the early stage, and the fogging degree measured after printing the pattern with a print coverage of 1% on 10000 sheets was defined as the fogging degree after a durability test.

Frictional Charge Quantity of Developer

The frictional charge quantity of the developer was measured for evaluating the ability of the developing roller to charge the developer.

The developer held in a narrow portion of the part of the developing roller between the developing blade and the contact position of the photosensitive member when the fogging degree had been examined was collected by suction using a metal cylinder and a cylindrical filter. At this time, the charge stored in a capacitor through the metal cylinder (using a meter 8252 manufactured by ADC) and the mass of the developer collected by suction were measured. The charge quality per unit mass (μC/g) was calculated from these values. For a negatively chargeable developer, whose charge quantity per unit mass is negative, the higher the absolute value of the charge quantity, the higher the charging ability of the developer. The frictional charge quantity measured in this measurement operation was defined as frictional charge quantity 2. As with the case of fogging degree, frictional charge quantity 2 measured after printing on 100 sheets was defined as frictional charge quantity 2 in the early stage, and the value measured after printing on 10000 sheets was defined as frictional charge quantity 2 after the durability test.

Examples 2, 3, 6 to 10, 15, 17, 19, 21, 24, 26, 28, and 29

Electroconductive rollers of Examples 2, 3, 6 to 10, 15, 17, 19, 21, 24, 26, 28, and 29 were produced in the same manner as in Example 1 except that the surface layer paint was replaced with that shown in Table 14.

TABLE 14

| | | Elastic layer No. | Surface layer paint No. |
|---|---|---|---|
| Example | 1 | D-1 | T-1 |
| | 2 | D-1 | T-2 |
| | 3 | D-1 | T-3 |
| | 4 | D-1 | T-4 |
| | 5 | D-1 | T-5 |
| | 6 | D-1 | T-6 |
| | 7 | D-1 | T-7 |
| | 8 | D-1 | T-8 |
| | 9 | D-1 | T-9 |
| | 10 | D-1 | T-10 |
| | 11 | D-1 | T-11 |
| | 12 | D-1 | T-12 |
| | 13 | D-1 | T-13 |
| | 14 | D-1 | T-14 |

TABLE 14-continued

| | | Elastic layer No. | Surface layer paint No. |
|---|---|---|---|
| | 15 | D-1 | T-15 |
| | 16 | D-1 | T-16 |
| | 17 | D-1 | T-17 |
| | 18 | D-1 | T-18 |
| | 19 | D-1 | T-19 |
| | 20 | D-1 | T-20 |
| | 21 | D-1 | T-21 |
| | 22 | D-1 | T-22 |
| | 23 | D-1 | T-23 |
| | 24 | D-1 | T-24 |
| | 25 | D-1 | T-25 |
| | 26 | D-1 | T-26 |
| | 27 | D-1 | T-27 |
| | 28 | D-1 | T-28 |
| | 29 | D-1 | T-29 |
| | 30 | D-1 | T-30 |
| | 31 | D-1 | T-31 |
| | 32 | D-1 | T-32 |
| Comparative Example | 1 | D-1 | T-33 |
| | 2 | D-1 | T-34 |
| | 3 | D-1 | T-35 |
| | 4 | D-1 | T-36 |
| | 5 | D-1 | T-37 |
| | 6 | D-1 | T-38 |

Example 4

Elastic roller D-1 produced above was dipped in surface layer paint T-4 to form a coating film over the surface of the elastic layer of elastic roller D-1, followed by drying Then, the roller was heated at 150° C. for 1 hour, and thus a surface layer of about 20 μm in thickness was formed to yield an electroconductive roller of Example 4.

Examples 5, 11 to 13, 18, and 20

Electroconductive rollers of Examples 5, 11 to 13, 18, and 20 were produced in the same manner as in Example 4 except that the surface layer paint was replaced with that shown in Table 14.

Example 14

An electroconductive roller of Example 14 was produced in the same manner as in Example 1 except that surface layer paint T-14 was used and that UV irradiation time was changed to 90 seconds.

Examples 16, 22, 23, 25, 27, and 30 to 32

Electroconductive rollers of Examples 16, 22, 23, 25, 27, and 30 to 32 were produced in the same manner as in Example 14 except that the surface layer paint was replaced with that shown in Table 14.

Comparative Example 1

Elastic roller D-1 produced above was dipped in surface layer paint T-33 to form a coating film over the surface of the elastic layer of elastic roller D-1, followed by drying. Then, the roller was heated at 130° C. for 1.5 hours, and thus an about 15 μm-thick surface layer was formed to yield an electroconductive roller of Comparative Example 1.

Comparative Examples 2, 5, and 6

Electroconductive rollers of Examples 2, 5, and 6 were produced in the same manner as in Comparative Example 1 except that the surface layer paint was replaced with that shown in Table 14.

Comparative Example 3

Elastic roller D-1 produced above was dipped in surface layer paint T-35 to form a coating film over the surface of the elastic layer of elastic roller D-1, followed by allowing a reaction at room temperature for 2 hours. Then, the roller was heated at 80° C. for 1 hour, and thus an about 15 μm-thick surface layer was formed to yield an electroconductive roller of Comparative Example 3.

Comparative Example 4

An electroconductive roller of Example 4 was produced in the same manner as in Comparative Example 3 except that the surface layer paint was replaced with that shown in Table 14.

The electroconductive rollers of Examples 2 to 30 and Comparative Examples 1 to 6 were evaluated in the same manner as in Example 1. The evaluation results as an electroconductive roller are shown in Table 15, and the evaluation results as a developing roller are shown in Table 17. For the electric resistance shown in Tables 15 and 17, for example, "1.25*10^8" represents "$1.25\times10^{8}$".

TABLE 15

| | | Electric resistance (Ω) | | | Frictional charge quantity 1 (μC/g) | |
|---|---|---|---|---|---|---|
| | | Early stage | | After environmental cycle test | | |
| | | N/N ENVIRONMENT | H/H ENVIRONMENT | N/N ENVIRONMENT | Early stage | After environmental cycle test |
| Example | 1 | 1.25*10^8 | 1.19*10^8 | 1.12*10^8 | −4.3 | −4.2 |
| | 2 | 1.14*10^8 | 9.37*10^7 | 9.15*10^7 | −4.0 | −3.6 |
| | 3 | 2.13*10^8 | 1.43*10^8 | 1.03*10^8 | −3.9 | −3.5 |
| | 4 | 2.52*10^8 | 2.37*10^8 | 2.13*10^8 | −4.1 | −4.0 |
| | 5 | 1.16*10^8 | 1.03*10^8 | 9.85*10^8 | −4.0 | −3.9 |
| | 6 | 1.17*10^8 | 5.56*10^7 | 7.85*10^7 | −4.0 | −3.3 |
| | 7 | 9.74*10^7 | 9.16*10^7 | 8.87*10^7 | −4.1 | −4.1 |
| | 8 | 1.32*10^8 | 1.21*10^8 | 1.03*10^8 | −4.2 | −4.1 |
| | 9 | 1.25*10^8 | 1.19*10^8 | 1.09*10^8 | −4.1 | −4 |
| | 10 | 1.78*10^8 | 1.17*10^8 | 9.25*10^7 | −4.0 | −3.6 |
| | 11 | 2.15*10^8 | 2.03*10^8 | 1.98*10^8 | −4.1 | −4 |
| | 12 | 1.97*10^8 | 8.24*10^7 | 8.01*10^7 | −4.0 | −3.3 |
| | 13 | 1.58*10^8 | 1.49*10^8 | 1.36*10^8 | −4.1 | −3.9 |
| | 14 | 1.38*10^8 | 1.31*10^8 | 1.05*10^8 | −4.0 | −3.9 |
| | 15 | 1.49*10^8 | 1.33*10^8 | 1.14*10^8 | −3.8 | −3.6 |
| | 16 | 1.61*10^8 | 8.21*10^7 | 8.1*10^7 | −4.0 | −3.5 |
| | 17 | 3.41*10^8 | 3.25*10^8 | 3.01*10^8 | −3.9 | −3.8 |
| | 18 | 2.05*10^8 | 9.78*10^7 | 9.10*10^7 | −4.1 | −3.4 |
| | 19 | 1.82*10^8 | 7.21*10^7 | 6.98*10^7 | −4.0 | −3.2 |
| | 20 | 2.25*10^8 | 9.91*10^7 | 9.01*10^7 | −4.0 | −3.5 |
| | 21 | 1.12*10^8 | 8.97*10^7 | 8.42*10^7 | −4.1 | −3.5 |
| | 22 | 1.42*10^8 | 6.98*10^7 | 6.67*10^7 | −3.9 | −3.2 |
| | 23 | 1.78*10^8 | 7.25*10^7 | 6.31*10^7 | −4.1 | −3.5 |
| | 24 | 1.94*10^8 | 8.13*10^7 | 7.99*10^7 | −3.8 | −3.3 |
| | 25 | 2.34*10^8 | 7.45*10^7 | 7.31*10^7 | −4.0 | −3.3 |
| | 26 | 2.16*10^8 | 1.82*10^8 | 9.25*10^7 | −4.2 | −3.9 |
| | 27 | 1.24*10^8 | 4.83*10^7 | 4.68*10^7 | −3.8 | −3.1 |
| | 28 | 2.31*10^8 | 9.41*10^7 | 8.97*10^7 | −3.9 | −3.4 |
| | 29 | 1.48*10^8 | 8.84*10^7 | 8.71*10^7 | −4.0 | −3.5 |

TABLE 15-continued

| | | Electric resistance (Ω) | | | | |
|---|---|---|---|---|---|---|
| | | Early stage | | After environmental cycle test | Frictional charge quantity 1 (μC/g) | |
| | | N/N ENVIRONMENT | H/H ENVIRONMENT | N/N ENVIRONMENT | Early stage | After environmental cycle test |
| | 30 | 3.78*10^8 | 9.78*10^7 | 8.13*10^7 | −4.1 | −3.5 |
| | 31 | 3.17*10^8 | 9.81*10^7 | 6.97*10^7 | −3.9 | −3.3 |
| | 32 | 3.65*10^8 | 9.67*10^7 | 8.01*10^7 | −3.9 | −3.2 |
| Comparative Example | 1 | 2.32*10^8 | 5.17*10^7 | 4.98*10^7 | −3.8 | −2.7 |
| | 2 | 1.78*10^8 | 3.78*10^7 | 2.98*10^7 | −3.9 | −2.8 |
| | 3 | 1.87*10^8 | 4.47*10^7 | 3.84*10^7 | −3.7 | −2.6 |
| | 4 | 2.15*10^8 | 4.13*10^7 | 3.98*10^7 | −3.9 | −2.9 |
| | 5 | 1.53*10^8 | 3.18*10^7 | 2.74*10^7 | −3.9 | −2.7 |
| | 6 | 1.17*10^8 | 3.81*10^7 | 2.98*10^7 | −3.8 | −2.6 |

Tables 16A and 16B show the structure of the chemical linkage between the cyclic molecules of the first polyrotaxane molecule and the cyclic molecules of the second polyrotaxane molecule in Examples 1 to 49 and Comparative Examples 1 to 6.

In Tables 16A and 16B, "cyclohexyl" in the column of "Substituent of R6 main chain" means that R6 in structural formula (8) is the cyclohexyl group.

Also, in Tables 16A and 16B, "Ether linkage" in the column of "Linkage in R6" means that the structure of structural formula (8) is represented by structural formula (8-1). Also, "Sulfide linkage" in the column of "Linkage in R6" means that the structure of structural formula (8) is represented by structural formula (8-2).

TABLE 16A

| | R1 structure | R2 structure | n1 | R3 | n2 | m | p1 | p2 | q1 | R4 carbon number | R5 |
|---|---|---|---|---|---|---|---|---|---|---|---|
| Example 1 | (2) | (2) | 3 | $CH_3$ | 1 | | | | | | |
| Example 2 | (2) | (2) | 3 | $CH_3$ | 1 | | | | | | |
| Example 3 | (2) | (2) | 3 | $CH_3$ | 1 | | | | | | |
| Example 4 | (2) | (2) | 3 | H | 4 | | | | | | |
| Example 5 | (2) | (2) | 3 | H | 4 | | | | | | |
| Example 6 | (2) | (2) | 3 | $CH_3$ | 1 | | | | | | |
| Example 7 | (3) | (3) | | | | 1 | | | | | |
| Example 8 | (3) | (3) | | | | 1 | | | | | |
| Example 9 | (3) | (3) | | | | 1 | | | | | |
| Example 10 | (3) | (3) | | | | 1 | | | | | |
| Example 11 | (3) | (3) | | | | 1 | | | | | |
| Example 12 | (3) | (3) | | | | 1 | | | | | |
| Example 13 | (4) | (4) | | | | | | | | | |
| Example 14 | (4) | (4) | | | | | | | | | |
| Example 15 | (4) | (4) | | | | | | | | | |
| Example 16 | (4) | (4) | | | | | | | | | |
| Example 17 | (4) | (4) | | | | | | | | | |
| Example 18 | (3) | (3) | | | | 0 | | | | | |
| Example 19 | (3) | (3) | | | | 0 | | | | | |
| Example 20 | (5) | (5) | | | | | 0 | 1 | | | |
| Example 21 | (5) | (5) | | | | | 0 | 1 | | | |
| Example 22 | (5) | (5) | | | | | 0 | 1 | | | |
| Example 23 | (5) | (5) | | | | | 1 | 0 | | | |
| Example 24 | (5) | (5) | | | | | 1 | 0 | | | |
| Example 25 | (5) | (5) | | | | | 1 | 0 | | | |
| Example 26 | (6) | (6) | | | | | | | 0, 1 | | |
| Example 27 | (6) | (6) | | | | | | | 0 | | |
| Example 28 | (6) | (6) | | | | | | | 1 | | |
| Example 29 | (6) | (6) | | | | | | | 1 | | |
| Example 30 | (5) | (5) | | | | | 1 | 0 | | | |
| Example 31 | (7) | (7) | | | | | | | | 19 | Hydrogen atom |
| Example 32 | (7) | (7) | | | | | | | | 47 | Methyl group |

| | R6 carbon number | Substituent of R6 main chain | Linkage in R6 | Substitution degree of structural formula (11) [%] | Percentage of substituents to total hydroxy groups [%] |
|---|---|---|---|---|---|
| Example 1 | 6 | | | 59 | 66.4 |
| Example 2 | 6 | | | 78 | 81.7 |
| Example 3 | 6 | | | 11 | 17.2 |
| Example 4 | 6 | Cyclohexyl group | | 13 | 33.0 |
| Example 5 | 5 | | Ether linkage | 56 | 69.6 |
| Example 6 | 0 | | | 0 | 58.0 |
| Example 7 | 6 | | | 59 | 66.4 |
| Example 8 | 6 | | | 59 | 66.4 |
| Example 9 | 6 | | | 59 | 66.4 |
| Example 10 | 6 | Cyclohexyl group | | 13 | 16.5 |

TABLE 16A-continued

| | | | | | |
|---|---|---|---|---|---|
| Example 11 | 5 | | | 56 | 65.2 |
| Example 12 | 2 | | | 73 | 77.9 |
| Example 13 | 6 | | | 59 | 61.9 |
| Example 14 | 5, 6 | | Sulfide linkage | 58 | 63.5 |
| Example 15 | 5 | | Ether linkage | 56 | 60.8 |
| Example 16 | 1 | | | 63 | 68.9 |
| Example 17 | 6 | | | 59 | 64.7 |
| Example 18 | 5, 6 | | Sulfide linkage | 58 | 60.9 |
| Example 19 | 2 | | | 73 | 76.5 |
| Example 20 | 6 | Cyclohexyl group | | 13 | 24.3 |
| Example 21 | 5 | | Ether linkage | 56 | 63.5 |
| Example 22 | 0 | | | 0 | 36.0 |
| Example 23 | 1 | | | 63 | 67.1 |
| Example 24 | 6 | Cyclohexyl group | | 13 | 22.6 |
| Example 25 | 1 | | | 63 | 67.8 |
| Example 26 | 5, 6 | | Sulfide linkage | 58 | 62.6 |
| Example 27 | 2 | | | 73 | 77.9 |
| Example 28 | 6 | | | 59 | 64.3 |
| Example 29 | 5 | | Ether linkage | 56 | 62.2 |
| Example 30 | 0 | | | 0 | 58.0 |
| Example 31 | 0 | | | 0 | 58.0 |
| Example 32 | 0 | | | 0 | 58.0 |

* Including structure (1) involved in binding

TABLE 16B

| | R1 structure | R2 structure | n1 | R3 | n2 | m | p1 | p2 | q1 | R4 carbon number | R5 | R6 carbon number |
|---|---|---|---|---|---|---|---|---|---|---|---|---|
| Comparative Example 1 | Urethane linkage | | | | | | | | | | | 6 |
| Comparative Example 2 | Urethane linkage | | | | | | | | | | | 0 |
| Comparative Example 3 | Triazine structure | | | | | | | | | | | 6 |
| Comparative Example 4 | Triazine structure | | | | | | | | | | | 3 |
| Comparative Example 5 | Urethane linkage | | | | | | | | | | | 5 |
| Comparative Example 6 | Urethane linkage | | | | | | | | | | | 5 |
| Example 33 | (2) | (2) | 3 | $CH_3$ | 1 | | | | | | | 6 |
| Example 34 | (2) | (2) | 3 | H | 4 | | | | | | | 6 |
| Example 35 | (2) | (2) | 3 | H | 4 | | | | | | | 5 |
| Example 36 | (3) | (3) | | | | 1 | | | | | | 6 |
| Example 37 | (3) | (3) | | | | 1 | | | | | | 6 |
| Example 38 | (3) | (3) | | | | 1 | | | | | | 6 |
| Example 39 | (3) | (3) | | | | 1 | | | | | | 6 |
| Example 40 | (3) | (3) | | | | 0 | | | | | | 2 |
| Comparative Example 7 | Urethane linkage | | | | | | | | | | | 6 |
| Comparative Example 8 | Triazine structure | | | | | | | | | | | 3 |
| Comparative Example 9 | Urethane linkage | | | | | | | | | | | 5 |
| Example 41 | (2) | (2) | 3 | $CH_3$ | 1 | | | | | | | 6 |
| Example 42 | (2) | (2) | 3 | H | 4 | | | | | | | 6 |
| Example 43 | (2) | (2) | 3 | H | 4 | | | | | | | 5 |
| Example 44 | (3) | (3) | | | | 1 | | | | | | 6 |
| Example 45 | (3) | (3) | | | | 1 | | | | | | 6 |
| Example 46 | (4) | (4) | | | | | | | | | | 5 |
| Example 47 | (4) | (4) | | | | | | | | | | 6 |
| Example 48 | (4) | (4) | | | | | | | | | | 5 |
| Example 49 | (4) | (4) | | | | | | | | | | 5 |
| Comparative Example 10 | Urethane linkage | | | | | | | | | | | 6 |
| Comparative Example 11 | Triazine structure | | | | | | | | | | | 3 |
| Comparative Example 12 | Urethane linkage | | | | | | | | | | | 5 |

| | Substituent of R6 main chain | Linkage in R6 | Substitution degree of structural formula (11) [%] | Percentage of substituents to total hydroxy groups [%] |
|---|---|---|---|---|
| Comparative Example 1 | | | 59 | 85.0 |
| Comparative Example 2 | | | 0 | 91.0 |
| Comparative Example 3 | | | 13 | 59.0 |
| Comparative Example 4 | | | 73 | 75.0 |
| Comparative Example 5 | | Sulfide linkage | 58 | 69.0 |
| Comparative Example 6 | | Ether linkage | 81 | 90.0 |
| Example 33 | | | 59 | 66.4 |
| Example 34 | Cyclohexyl group | | 13 | 33.0 |
| Example 35 | | Ether linkage | 56 | 69.6 |

TABLE 16B-continued

| | | | | |
|---|---|---|---|---|
| Example 36 | | | 59 | 66.4 |
| Example 37 | | | 13 | 16.5 |
| Example 38 | Cyclohexyl group | | 13 | 21.7 |
| Example 39 | Cyclohexyl group | | 13 | 82.6 |
| Example 40 | | | 73 | 76.5 |
| Comparative Example 7 | | | 59 | 85.0 |
| Comparative Example 8 | | | 73 | 75.0 |
| Comparative Example 9 | | Sulfide linkage | 58 | 69.0 |
| Example 41 | | | 59 | 66.4 |
| Example 42 | Cyclohexyl group | | 13 | 33.0 |
| Example 43 | | Ether linkage | 56 | 69.6 |
| Example 44 | Cyclohexyl group | | 59 | 66.4 |
| Example 45 | | | 13 | 16.5 |
| Example 46 | | Ether linkage | 56 | 60.8 |
| Example 47 | | | 59 | 61.9 |
| Example 48 | | Ether linkage | 56 | 60.8 |
| Example 49 | | Ether linkage | 56 | 84.8 |
| Comparative Example 10 | | | 59 | 85.0 |
| Comparative Example 11 | | | 73 | 75.0 |
| Comparative Example 12 | | Sulfide linkage | 58 | 69.0 |

* Including structure (1) involved in binding

In evaluation as an electroconductive roller, all samples of the Examples exhibited small fluctuation in the electrical resistance when comparing the electrical resistance of between in the early stage under the N/N environment, and the electrical resistance in the early stage under the H/H environments. Further, a fluctuation in the electrical resistance when comparing the electrical resistance in the early stage under the N/N environment, and the electrical resistance after the environmental cycle test. In addition, the rage of change in frictional charge quantity after environment cycle test with respect to the frictional charge quantity in the early stage, is suppressed. The rage of change is obtained by dividing the absolute value of the difference between the frictional charge quantity after environment cycle test, and the frictional charge quantity in the early stage with the frictional charge quantity in the early stage. Since the bound polyrotaxanes according to Examples 1 to 32 have linkages containing any of the structures of structural formulas (2) to (7), the electric resistance after the environmental cycle test was high, and "frictional charge quantity 1" after the environmental cycle was also high.

Particularly in Examples 1 to 5, 7 to 11, 13 to 15, 17, 18, 20, 21, 24, 26, 28, and 29, the fluctuations and the rate of change are particularly suppressed.

This is probably because some of the hydroxy groups of the cyclic molecules in these Examples are substituted with the group represented by structural formula (8).

The bound polyrotaxanes according to Examples 1 to 5, 7 to 11, 13 to 15, and 17, have linkages containing any of the structural formulas (2) to (4). This is advantageous for stabilizing the electrical resistance and the frictional charge quantity.

Among them, in Examples 1, 4, 5, 7 to 9, 11, 13 to 15, and 17, in which the bound polyrotaxanes having linkages containing the structure of structural formula (1) or the structure of structural formula (8) are contained in the surface layers, and 20% to 80% of all the hydroxy groups of the cyclic molecules of the polyrotaxane have been substituted with the structure, the variation in resistance is further reduced even after the environmental cycle test. In addition, the decrease in frictional charge quantity after the durability was as small as 0.2. Thus, these Examples exhibited good stability.

On the other hand, in Comparative Examples 1 to 6, which did not contain the bound polyrotaxane having linkages containing any of the structures represented by structural formulas (2) to (7), the resistance was largely varied after the environmental cycle test. Accordingly, the electric resistance was low, and frictional charge quantity 1 after the environmental cycle test was also low.

In Comparative Examples 1 and 3, the hydroxy groups and isocyanate groups of the α-CD molecules of the bound polyrotaxane are bound to form urethane linkages. The hydrogen bond between the urethane linkages restricts the α-CD molecules in the polyrotaxane molecule. This is probably a reason why the resistance decreased after the environmental cycle test.

In Comparative Example 2, the polyrotaxane molecules are bound with a linkage containing cyanuric groups having aromatic properties. The inventors think that the π-π stacking of the cross-links restricts the α-CD molecules, thereby reducing the resistance after the environmental cycle test.

TABLE 17

| | Initial triboelectric charge quantity 1 (μC/g) | Triboelectric charge quantity 1 after durability test (μC/g) | Initial fogging (%) | Fogging after durability test (%) |
|---|---|---|---|---|
| Example 1 | −42 | −41 | 1.5 | 1.7 |
| Example 2 | −41 | −37 | 1.6 | 2.1 |
| Example 3 | −43 | −38 | 1.7 | 2.2 |
| Example 4 | −42 | −40 | 1.3 | 1.6 |
| Example 5 | −41 | −40 | 1.5 | 1.6 |
| Example 6 | −42 | −35 | 1.8 | 3.2 |
| Example 7 | −43 | −42 | 1.3 | 1.4 |
| Example 8 | −41 | −39 | 1.4 | 1.5 |
| Example 9 | −41 | −39 | 1.3 | 1.5 |
| Example 10 | −42 | −39 | 1.8 | 2.2 |
| Example 11 | −41 | −39 | 1.4 | 1.6 |
| Example 12 | −40 | −34 | 2.1 | 3.5 |
| Example 13 | −42 | −41 | 1.6 | 1.7 |
| Example 14 | −40 | −39 | 1.5 | 1.7 |
| Example 15 | −41 | −39 | 1.4 | 1.6 |
| Example 16 | −40 | −33 | 1.9 | 3.0 |
| Example 17 | −40 | −38 | 1.7 | 1.9 |
| Example 18 | −41 | −35 | 1.8 | 2.6 |
| Example 19 | −38 | −31 | 2.3 | 3.5 |
| Example 20 | −40 | −36 | 1.9 | 2.5 |

TABLE 17-continued

| | Initial triboelectric charge quantity 1 (μC/g) | Triboelectric charge quantity 1 after durability test (μC/g) | Initial fogging (%) | Fogging after durability test (%) |
|---|---|---|---|---|
| Example 21 | −39 | −35 | 2.0 | 2.8 |
| Example 22 | −37 | −31 | 2.3 | 3.6 |
| Example 23 | −39 | −35 | 2.1 | 2.8 |
| Example 24 | −38 | −35 | 1.9 | 2.7 |
| Example 25 | −36 | −31 | 2.3 | 3.8 |
| Example 26 | −40 | −36 | 2.0 | 2.9 |
| Example 27 | −38 | −33 | 2.2 | 3.5 |
| Example 28 | −39 | −36 | 2.1 | 2.8 |
| Example 29 | −40 | −35 | 1.9 | 2.8 |
| Example 30 | −38 | −34 | 2.0 | 2.9 |
| Example 31 | −37 | −33 | 2.3 | 3.2 |
| Example 32 | −39 | −33 | 2.4 | 3.1 |
| Comparative Example 1 | −33 | −26 | 2.7 | 5.1 |
| Comparative Example 2 | −32 | −25 | 2.8 | 5.2 |
| Comparative Example 3 | −35 | −24 | 2.5 | 5.4 |
| Comparative Example 4 | −38 | −25 | 2.0 | 5.1 |
| Comparative Example 5 | −34 | −22 | 2.5 | 5.6 |
| Comparative Example 6 | −37 | −21 | 2.2 | 5.9 |

Since the polyrotaxanes used in Examples 1 to 30 have any of the structures of structural formulas (2) to (7), frictional charge quantity 1 was high after the durability test in the evaluation as a developing roller. In addition, the fogging degree in the H/H environment was less than 5%.

Particularly in Examples 1 to 5, 7 to 11, 13 to 15, 17, 18, 20, 21, 24, 26, 28, and 29, the fogging degree in the H/H environment was as good as less than 3% even after the durability test.

In Examples 1 to 5, 7 to 11, 13 to 15, and 17, in which the polyrotaxane had a structure represented by any of the structural formulas (2) to (4), the frictional charge quantity after the durability test was high, and the fogging degree in the H/H environment was less than 2.5%.

In Examples 1, 4, 5, 7 to 9, 11, 13 to 15, and 17, furthermore, the difference between the frictional charge quantities before and after the durability test was as small as 2 or less, thus showing stable frictional charge quantity, and the fogging degree in the H/H environment was as very good as less than 2.0%.

On the other hand, in Comparative Examples 1 to 6, which did not contain a polyrotaxane having any of the structures represented by structural formulas (2) to (7), the frictional charge quantity was decreased after the durability test while the frictional charge quantity in the early stage was good, and the fogging degree was also degraded by the durability test.

Evaluation as Charging Roller

Example 33

Elastic roller D-2 produced above was dipped in surface layer paint T-39 to form a coating film over the surface of the elastic layer of elastic roller D-2, followed by drying. The subsequent operation was performed in the same manner as in Example 1, and thus an electroconductive roller of Example 33 was produced.

Electric Resistance

The electric resistance at the early stage of the electroconductive roller of Example 33 was measured in the same manner as in the measurement of the electric resistance of Example 1, except that the applied voltage was varied to 200 V. For this evaluation as a charging roller, the charging roller was allowed to stand in the N/N environment and the H/H environment each for 6 hours or more before measurement.

Measurement of Electric Resistance after Environmental Cycle Test

The electric resistance after the environmental cycle test was measured in the same manner as in the measurement of the electric resistance after the environmental cycle test in Example 1.

Lateral Streaks Formed in Print in H/H Environment

If the resistance of the charging roller decreases, thin lines can be formed in a printed white solid pattern. Such lines are referred to as lateral streaks. The lateral streaks worsen as the electric resistance decreases, and become more conspicuous as the period of use is increased. Samples of the electrophotographic member of the present disclosure were evaluated as charging rollers in the following manner.

The electroconductive roller of Example 33 was mounted as a charging roller in an electrophotographic laser printer HP Color Laserjet Enterprise CP4515dn (manufactured by HP). The laser printer provided with the charging roller was allowed to stand in the H/H environment for 2 hours. Subsequently, a black pattern with a print coverage of 4% (lateral lines of 2 dots in width at intervals of 50 dots formed in the direction perpendicular to the rotation of the photosensitive member) was continuously output for testing the durability. This printing operation was suspended for 10 minutes every 100 sheets as with the operation for the evaluation as a developing roller. Also, a white solid pattern was printed for checking after 100 sheet output and 10000 sheets output. The solid pattern was visually observed, and the degree of lateral streaks was examined. The examination after 100 sheet output was defined as the early-stage examination, and that after 10000 sheet output was defined as the examination after the durability test.

A: No lateral streaks were formed.

B: Minor lateral streaks were formed at only some edge of the output pattern.

C: Conspicuous lateral streaks were formed almost half of the area of the pattern.

Examples 34 to 40

Electroconductive rollers of Examples 33 to 40 were produced in the same manner as in Example 33 except that the surface layer paint was replaced with that shown in Table 18. The curing in Examples 34 and 35 was, however, performed in the same manner as in Example 3.

Comparative Examples 7 to 9

Electroconductive rollers of Examples 7 to 9 were produced in the same manner as Example 33 except that the surface layer paint was replaced with that shown in Table 18. However, the curing in Comparative Examples 7 and 9 was performed in the same manner as in Comparative Example 1, and the curing in Comparative Example 8 was performed in the same manner as in Comparative Example 2.

TABLE 18

| | Elastic layer No. | Paint No. |
|---|---|---|
| Example 33 | D-2 | T-39 |
| Example 34 | D-2 | T-40 |
| Example 35 | D-2 | T-41 |
| Example 36 | D-2 | T-42 |
| Example 37 | D-2 | T-43 |
| Example 38 | D-2 | T-44 |
| Example 39 | D-2 | T-45 |
| Example 40 | D-2 | T-46 |
| Comparative Example 7 | D-2 | T-50 |
| Comparative Example 8 | D-2 | T-51 |
| Comparative Example 9 | D-2 | T-52 |

The electroconductive rollers of Examples 33 to 40 and Comparative Examples 7 to 9 were evaluated in the same manner as in Example 33. The results are shown in Table 19.

TABLE 19

| | Electric resistance (Ω) in early stage | Electric resistance (Ω) after environmental cycle test | Lateral streaks at beginning of H/H environment test | Lateral streaks after H/H environment test |
|---|---|---|---|---|
| Example 33 | $2.21*10^{8}$ | $1.97*10^{8}$ | A | A |
| Example 34 | $3.15*10^{8}$ | $2.75*10^{8}$ | A | A |
| Example 35 | $2.41*10^{8}$ | $2.13*10^{8}$ | A | A |
| Example 36 | $3.64*10^{8}$ | $3.48*10^{8}$ | A | A |
| Example 37 | $1.98*10^{8}$ | $1.68*10^{8}$ | A | A |
| Example 38 | $2.27*10^{8}$ | $1.99*10^{8}$ | A | A |
| Example 39 | $2.14*10^{8}$ | $1.98*10^{8}$ | A | A |
| Example 40 | $2.14*10^{8}$ | $1.43*10^{8}$ | A | B |
| Comparative Example 7 | $2.17*10^{8}$ | $8.31*10^{7}$ | A | C |
| Comparative Example 8 | $1.48*10^{8}$ | $7.10*10^{7}$ | B | C |
| Comparative Example 9 | $2.10*10^{7}$ | $7.31*10^{7}$ | A | C |

Each Example resulted in high image quality. Examples 33 to 40, in which the polyrotaxane in the surface layer had any of the structures represented by structural formulas (2) to (5), exhibited small decrease in resistance after the environmental cycle test, and produced high image quality even in the H/H environment.

Particularly in Examples 33 to 39, in which the polyrotaxane has any of the structures represented by structural formulas (2) to (4) and in which some of the hydroxy groups of the cyclic molecules are substituted with the structure of structural formula (8), the electric resistance was high after the environmental cycle test, and therefore there were not observed lateral streaks after the durability test.

In Examples 33 to 37, the variation in electric resistance after the environmental cycle test was further reduced.

On the other hand, in Comparative Examples 7 to 9, in which the polyrotaxane did not have any of the structures represented by structural formulas (2) to (4), lateral streaks were formed in the H/H environment. This is probably because the resistance decreased in the H/H environment. The decrease in resistance causes leakage between the photosensitive member and the electroconductive roller and consequently distorts the electrostatic latent image. Probably, this is the reason why the lateral streaks were formed.

Evaluation as Developing Blade

Example 41

A 0.08 mm-thick SUS sheet (manufactured by Nisshin Steel) was cut into dimensions of 200 mm by 23 mm as a support member by pressing. Subsequently, the portion of 1.5 mm from an end of the cut SUS sheet in the longitudinal direction was dipped in the surface layer paint of Example 34 to form a coating film, followed by drying. The coating film was irradiated for 40 seconds with ultraviolet light with an illuminance of 800 mW from a high-pressure mercury-vapor lamp (manufactured by Ushio) from a distance of 10 cm, thus forming an about 15 μm-thick resin layer on the surface of the end portion of the SUS sheet. Thus a developing blade of Example 41 was produced.

Measurement of Blade Resistance

The resistance of the blade was measured using the test jig shown in FIGS. 5A and 5B. More specifically, while each end of the blade, but the portion of the support member not having a resin layer, was being pressed at a load of 4.9 N with an electroconductive bearing 38, the blade was fixed without rotating a metal columnar member 37 of 40 mm in diameter. Subsequently, a voltage of 50 V was applied from a high-voltage power supply 39, and the difference in potential was measured between the ends of a resistor having a known resistance (two or more digits lower than the electric resistance of the blade) disposed between the metal columnar member 37 and the ground. For this measurement, 189 TRUE RMS MULTIMETER (manufactured by FLUKE) was used as a voltmeter 40. The current flowing to the columnar metal member through the electroconductive blade was calculated from the potential difference measured and the electric resistance of the resistor. The electric resistance of the electroconductive blade was determined by dividing the applied voltage 50 V by the current calculated.

The potential difference used for the calculation was the average of potential values measured for 3 seconds from 2 seconds after the start of voltage application. The obtained electric resistance was defined as the blade resistance at the early stage.

For this measurement, the developing blade was allowed to stand in N/N environment and the H/H environment each for 6 hours or more in advance.

Measurement of Blade Resistance after Environmental Cycle Test

An environmental cycle test was performed in the same manner as in the measurement of the electric resistance after the environmental cycle test in Example 1. Then, the resistance of the blade was measured as the blade resistance after the environmental cycle test in the same manner as the blade resistance in the early stage.

Fogging Degree

The degree of fogging was examined in the same manner as in Example 1 except that the original developing blade was replaced with the developing blade of the present Example, whereas the original developing roller was not replaced.

Examples 42 to 49

Developing blades of Examples 42 to 49 were produced in the same manner as in Example 41 except that the surface layer paint was replaced with that shown in Table 20. The curing in Examples 42 and 43 was, however, performed in the same manner as in Example 3.

Comparative Examples 10 to 12

Developing blades of Comparative Examples 10 to 12 were produced in the same manner as in Example 41 except that the surface layer paint was replaced with that shown in Table 20. In Comparative Examples 10 and 12, the curing was performed in the same manner as those in Comparative Examples 1 and 3, respectively, and in Comparative Example 11, the curing was performed in the same manner as that in Comparative Example 2.

TABLE 20

| | Paint No. |
|---|---|
| Example 41 | T-39 |
| Example 42 | T-40 |
| Example 43 | T-41 |
| Example 44 | T-42 |
| Example 45 | T-43 |
| Example 46 | T-46 |
| Example 47 | T-47 |
| Example 48 | T-48 |
| Example 49 | T-49 |
| Comparative Example 10 | T-50 |
| Comparative Example 11 | T-51 |
| Comparative Example 12 | T-52 |

The developing blades of Examples 41 to 49 and Comparative Examples 10 to 12 were evaluated in the same manner as in Example 39. The results are shown in Table 21.

TABLE 21

| | Developing blade resistance (Ω) | | Fogging degree (%) | |
|---|---|---|---|---|
| | Early stage | After environmental cycle test | Early stage | After curability test |
| Example 41 | 3.41*10^8 | 2.98*10^8 | 1.5 | 1.7 |
| Example 42 | 2.37*10^8 | 2.14*10^8 | 1.6 | 1.8 |
| Example 43 | 3.68*10^8 | 3.53*10^8 | 1.5 | 1.8 |
| Example 44 | 2.79*10^8 | 9.78*10^8 | 1.7 | 1.9 |
| Example 45 | 3.68*10^8 | 3.57*10^8 | 2.2 | 3.4 |
| Example 46 | 4.11*10^8 | 3.98*10^8 | 1.7 | 1.9 |
| Example 47 | 3.01*10^8 | 2.51*10^8 | 1.6 | 1.8 |
| Example 48 | 2.98*10^8 | 1.98*10^8 | 1.7 | 2.4 |
| Example 49 | 3.17*10^8 | 1.84*10^8 | 1.8 | 2.4 |
| Comparative Example 10 | 2.75*10^8 | 8.71*10^7 | 1.9 | 5.1 |
| Comparative Example 11 | 3.41*10^8 | 9.71*10^7 | 1.7 | 5.3 |
| Comparative Example 12 | 2.13*10^8 | 8.41*10^7 | 2.0 | 5.5 |

Examples 41 to 49, in which the polyrotaxane in the surface layer had any of the structures represented by structural formulas (2) to (4), exhibited small difference between the resistance at the early stage and the resistance after the environmental cycle test, and a fogging degree of less than 5% in the H/H environment after the durability test.

Particularly in Examples 41 to 44 and 46 to 48, the blade resistance was kept high even after the environmental cycle test because of the polyrotaxane having the structure represented by any of structural formulas (2) to (4).

Also, the developing blades of these Examples exhibited a good fogging degree of less than 3% in the H/H environment after the durability test.

In Examples 41 to 44, 46, and 47, furthermore, the developing blades exhibited an excellent fogging degree of less than 2.0% in the H/H environment after the durability test.

On the other hand, Comparative Examples 10 to 12, in which the polyrotaxane in the surface layer did not have the structure represented by any of structural formulas (2) to (7), exhibited a large difference between the blade resistances before and after the environmental cycle test. Also, the blade resistance after the environmental cycle test was low, and accordingly the fogging degree in the H/H environment was degraded by the durability test. This is probably because the decrease in blade resistance by the durability test led to a degraded charging ability as in the case of the developing roller, and thus did not allow the toner to be charged to a predetermined potential.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-123029, filed Jun. 18, 2015, which is hereby incorporated by reference herein in its entirety.

What is claimed is:

1. An electrophotographic member comprising:

an electroconductive substrate; and an electroconductive surface layer containing:

an electroconductivity imparting agent; and a bound polyrotaxane of which a first polyrotaxane and a second polyrotaxane are crosslinked, the first polyrotaxane molecule including first cyclic molecules each of which has at least one hydroxy group, and a first linear-chain molecule threaded through the first cyclic molecules, the first linear-chain molecule including two blocking groups at both ends thereof so as to prevent the first cyclic molecules from being dissociated from the first linear-chain molecule, the second polyrotaxane molecule including a-second-cyclic molecules each of which has at least one hydroxy group, and a second linear-chain molecule threaded through the second cyclic molecules, the second linear-chain molecule including two blocking group at both ends thereof so as to prevent the second cyclic molecules from being dissociated from the second linear-chain molecule, each of the first cyclic molecules being bound to each of the second cyclic molecules with a linkage which binds an oxygen atom derived from the hydroxy group in each of the first cyclic molecules, and an oxygen atom derived from the hydroxy group in each of the second cyclic molecules, the linkage having structures at both ends adjacent to the respective oxygen atoms, wherein each of the structures is selected from the group consisting of structures represented by formulae (2) to (7):

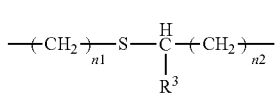

(2)

-continued (3)

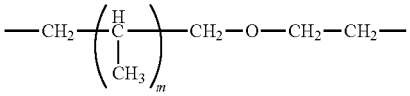

(4)

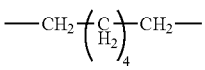

(5)

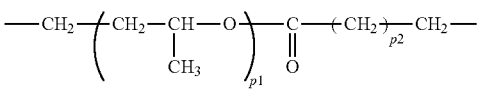

(6)

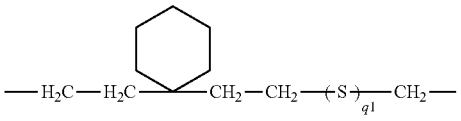

(7)

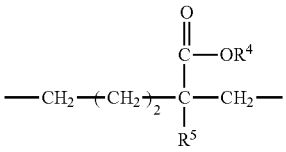

wherein in structural formula (2), $R^3$ represents a hydrogen atom or a methyl group, and n1 and n2 each represent an integer of 1 to 4, in structural formula (3), m represents 0 or 1, in structural formula (5), p1 and p2 each represent 0 or 1, in structural formula (6), q1 represents 0 or 1, and in structural formula (7), $R^4$ represents a hydrocarbon group having a carbon number of 5 to 47 or an alkyl group having a polyether structure and a total carbon number of 5 to 47, and $R^5$ represent a hydrogen atom or a methyl group.

2. The electrophotographic member according to claim 1, wherein the first cyclic molecules and the second cyclic molecules further have a group represented by the following structural formula (8): —O—$R^6$, wherein $R^6$ represents a group selected from the group consisting of aliphatic hydrocarbon groups having a carbon number of 5 or 6, alkoxy-substituted alkyl groups having a total carbon number of 5 or 6, and thioether-substituted alkyl groups having a total carbon number of 5 or 6.

3. The electrophotographic member according to claim 1, wherein the electroconductivity imparting agent is at least one of carbon black and an ionic conducting agent.

4. A process cartridge capable of being removably attached to an electrophotographic apparatus, the process cartridge comprising the electrophotographic member as set forth in claim 1.

5. An electrophotographic apparatus comprising:

an electrophotographic photosensitive member; and the electrophotographic member as set forth in claim 1.

* * * * *